US007854691B2

(12) United States Patent
Long et al.

(10) Patent No.: US 7,854,691 B2
(45) Date of Patent: Dec. 21, 2010

(54) EXERCISE APPARATUS

(75) Inventors: Yun-Bo Long, Songjiang (CN); Hung-Mao Liao, Ta Ya Hsiang (TW); Te-Chang Huang, Ta Ya Hsiang (TW)

(73) Assignee: Johnson Health Tech Co., Ltd., Taichung Hsien (TW)

( * ) Notice: Subject to any disclaimer, the term of this patent is extended or adjusted under 35 U.S.C. 154(b) by 0 days.

(21) Appl. No.: 12/721,574

(22) Filed: Mar. 11, 2010

(65) Prior Publication Data

US 2010/0167880 A1 Jul. 1, 2010

Related U.S. Application Data

(63) Continuation-in-part of application No. 12/321,294, filed on Jan. 21, 2009, now Pat. No. 7,704,193, which is a continuation of application No. 11/497,139, filed on Aug. 2, 2006, now Pat. No. 7,530,930.

(51) Int. Cl.
*A63B 69/16* (2006.01)

(52) U.S. Cl. ..... 482/57; 482/51; 482/52; 482/70

(58) Field of Classification Search ..... 482/41–53, 482/57–65, 70, 71, 79, 80
See application file for complete search history.

(56) References Cited

U.S. PATENT DOCUMENTS

| | | | | |
|---|---|---|---|---|
| 5,540,637 | A | 7/1996 | Rodgers | |
| 6,007,462 | A | 12/1999 | Chen | |
| 6,149,551 | A | 11/2000 | Pyles et al. | |
| 6,390,953 | B1 * | 5/2002 | Maresh et al. | 482/52 |
| 6,390,954 | B1 | 5/2002 | Lee | |
| 6,450,925 | B1 * | 9/2002 | Kuo | 482/52 |
| 6,689,019 | B2 * | 2/2004 | Ohrt et al. | 482/52 |
| 7,361,122 | B2 * | 4/2008 | Porth | 482/52 |
| 7,377,881 | B2 * | 5/2008 | Moon | 482/52 |
| 7,404,785 | B2 * | 7/2008 | Stearns et al. | 482/52 |
| 7,462,135 | B2 | 12/2008 | Lo | |

FOREIGN PATENT DOCUMENTS

DE 202007011406 U 11/2007

* cited by examiner

*Primary Examiner*—Glenn Richman

(57) ABSTRACT

An exercise apparatus is disclosed herein, including a frame, a rotating assembly, two supporting rods, two swing arms, two links, and two pedals. The front ends of the supporting rods are connected respectively to two connecting points of the rotating assembly, and the rear end of each supporting rod moves back and forth along a corresponding track. The front ends of the links are connected respectively at two swing ends of the swing arms. Each pedal is mounted at the rear end of a corresponding link and pivotally coupled to a corresponding supporting member. The distance between the bottom of a circular path of the connecting points and the tracks is smaller than 10 cm. The length of the supporting rod is smaller than two times diameter of the circular path. The longitudinal horizontal distance between the front edge of the closed path and the rear edge of the circular path is smaller than 20 cm. The rear ends of the supporting rods are located between the front ends and rear ends of the pedals.

19 Claims, 16 Drawing Sheets

EXERCISE APPARATUS

CROSS-REFERENCE TO RELATED APPLICATION

This is a continuation-in-part of U.S. patent application Ser. No. 12/321,294, filed on Jan. 21, 2009 now U.S. Pat. No. 7,704,193, which is a continuation of U.S. patent application Ser. No. 11/497,139, filed on Aug. 2, 2006 now U.S. Pat. No. 7,530,930.

BACKGROUND

1. Field of the Invention

This invention relates to an exercise apparatus and, more particularly to an elliptical exercise apparatus with small size for reducing space occupation.

2. Description of the Related Art

Elliptical exercise apparatus has been popular in recent years. Generally, elliptical exercise apparatus can guide a left pedal and a right pedal to move along an elliptical moving path for simulating walking, running, and stair climbing.

For example, an elliptical exercise apparatus is disclosed in U.S. Pat. No. 6,390,954. The elliptical exercise apparatus comprises a crank mounted at the front end of the frame; left and right tracks mounted at the rear end of the frame; left and right supporting rods mounted on left and right sides respectively; and left and right swing arms mounted at the front end of the frame. The front end of each supporting rod pivotally connects to a crank arm of the crank, so that the front ends can move along a circular path. The left and right supporting rods each has a roller mounted pivotally on the rear end, and the rollers move back and forth on the tracks. Two pedals are mounted respectively to the upper surfaces of the middle sections of supporting rods. Each swing arm has a top end for forming a handle, and a lower end connects to the corresponding supporting rod via a link. The left and right pedals move along a substantial elliptical closed path, and the left and right handles move back and forth correspondingly with the pedals.

The aforesaid elliptical exercise apparatus suffers from some shortcomings. First, the motion path of the pedals needs an adequate longitudinal length for exercising a user's legs, and the tracks at the rear end of the frame are longer than the longitudinal length of the motion path of the pedals, so the longitudinal length of the elliptical exercise apparatus is so long that it needs more space to be placed. Second, because the pedals are fixed securely on the supporting rods, the angle of the pedals varies with the motion path of the supporting rods. During operation period, the movement status of the user's feet is not conformed to the actual movement status. Preferably, the upper surface of each pedal is substantially horizontal when the pedal is at the bottom of the path. When the pedal is in the other segments, the front end of the pedal should be lower than the rear of the pedal, and it is apparent when the pedal is at the top of the path.

U.S. Pat. No. 6,007,462 shows a small elliptical exercise apparatus which includes a frame; a crank mounted at the rear end of the frame; left and right swing arms mounted pivotally at the front end of the frame; and left and right supporting rods connected respectively to the lower ends of the swing arms and corresponding crank arm. Two pedals are mounted on the supporting rods respectively. Thereby the left and right pedals move along a substantial elliptical closed path. The longitudinal length of the elliptical exercise apparatus is small enough to be placed in a limited space. However, the pedal motion doesn't conform with ergonomics. When each pedal moves to the bottom of the elliptical path, the front end of the pedal is higher than the rear end of the pedal. But the real situation is that while a person is walking or running, while his foot is on the ground, the sole of the foot should be horizontal on the ground surface.

SUMMARY

In a preferred embodiment of the present invention, the elliptical exercise apparatus comprises: a frame adapted to rest on a surface, the frame including a front end, a rear end, a front region, and a rear region, the rear region having two tracks extending longitudinally; a rotating assembly mounted on the front region of the frame and having two opposite connecting points moving along a circular path, and the distance between the bottom of the circular path and the tracks is smaller than 10 cm; a flywheel mounted pivotally on the front region of the frame and connected to the rotating assembly, the flywheel being rotatable simultaneously with the connecting points; left and right supporting rods each having a front end, a rear end, and a supporting member therebetween, the respective distances between the front ends and the corresponding rear ends of the supporting rods being greater than the diameter of the circular path and smaller than two times diameter of the circular path, the supporting member located between the rear and the middle of the supporting rod, the front ends of the supporting rods connected pivotally to the connecting points respectively, the rear ends of the supporting rods moving along the track between a front point and a rear point so as to cause the supporting member to move along an arcuate closed path, therefore in the longitudinal direction, the front edge of the closed path aligns transversely or is in back of the rear edge of the circular path, and the longitudinal horizontal distance between the front edge of the closed path and the rear edge of the circular path is smaller than 20 cm; left and right swing arms each having a pivot point connected to the front region of the frame, and a swing end located below the pivot point for moving back and forth; left and right links each having a front end and a rear end, the front ends respectively pivotally connected to the corresponding swing ends of the swing arms; and left and right pedals connected respectively to the rear ends of the links and located behind the corresponding supporting members of the supporting rods, the left and right pedals further connected pivotally to the supporting members; wherein in the longitudinal direction, the front point of the track aligns transversely or is in back of the front edge of the motion path of the front ends of the pedals, and the rear point of the track aligns transversely or is in front of the rear edge of the motion path of the rear ends of the pedals.

Several objects and advantages of the present invention are: (a) to provide an elliptical exercise apparatus with an adequate path for the travel by a user's feet; (b) to provide an elliptical exercise apparatus with an ergonomic pedal motion; (c) to provide an elliptical exercise apparatus with a shorter longitudinal length.

DETAIL DESCRIPTION

Figure 1:
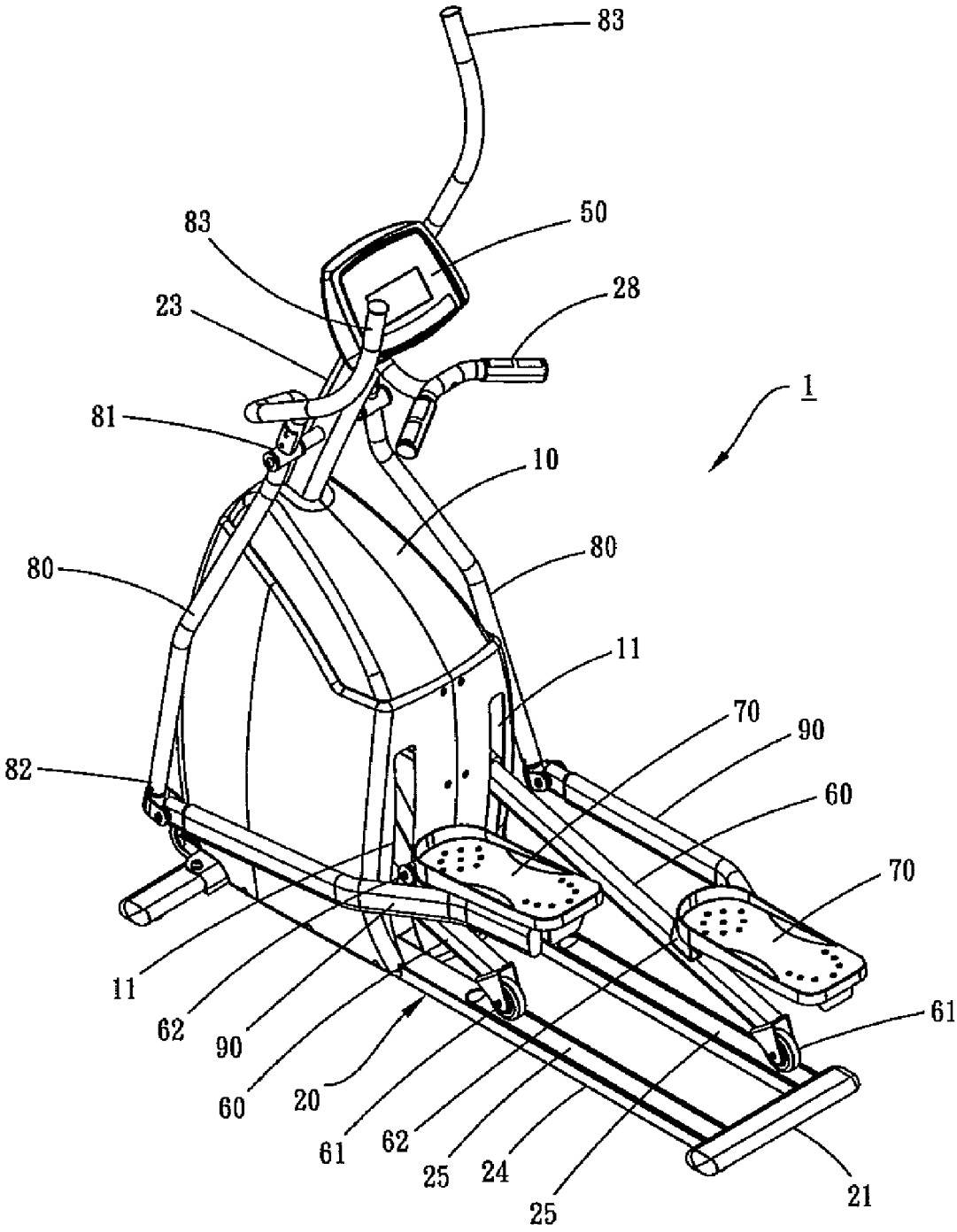
FIG. 1 is a perspective view of a first embodiment of the present invention.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

A first embodiment elliptical exercise apparatus constructed according to the present invention is designated 1 in FIGS. 1-6, wherein FIGS. 3-6 illustrate the elliptical exercise apparatus 1 without a shroud 10.

Figure 2:
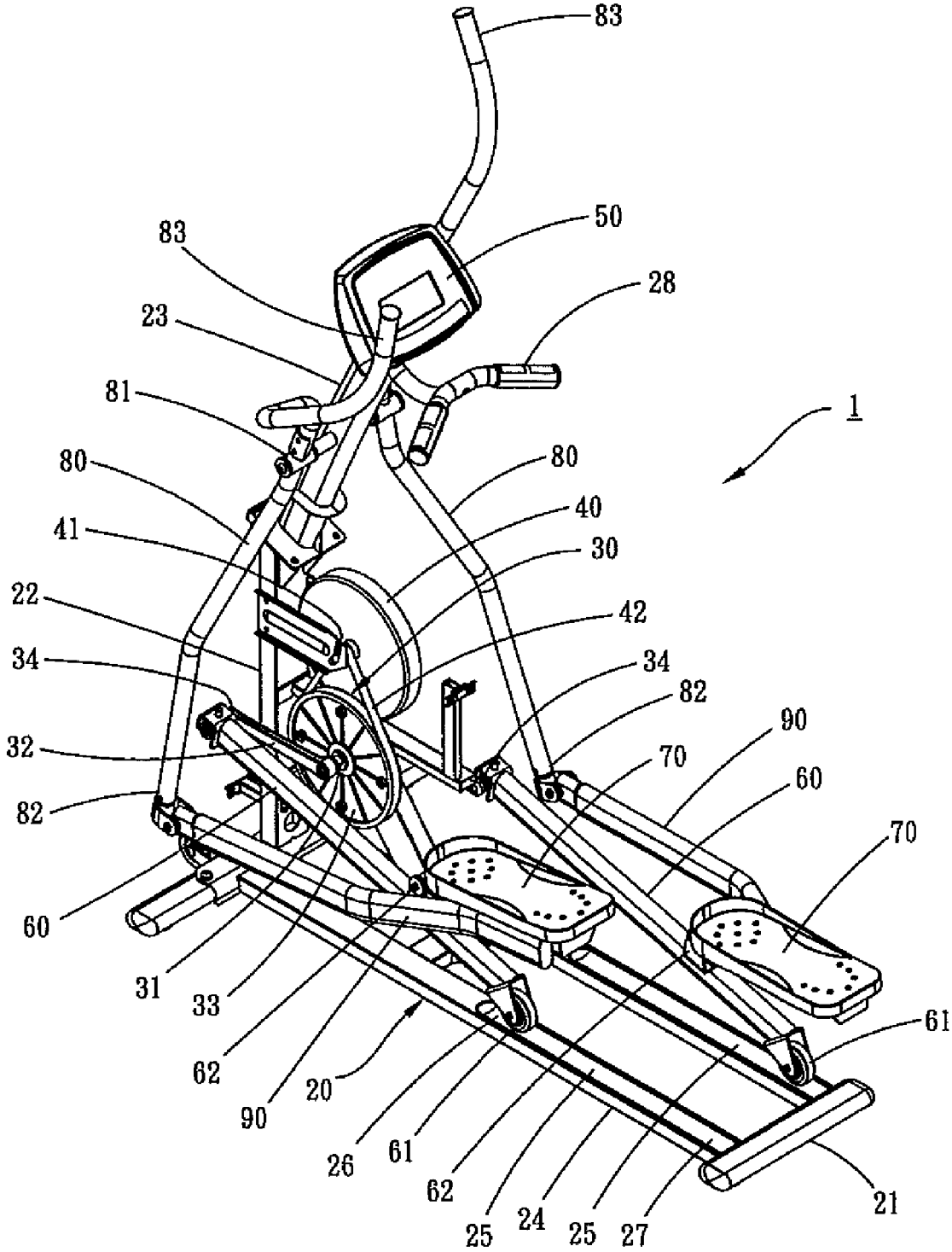
FIG. 2 is a perspective view of the first embodiment of FIG. 1 without the shroud.
Figure 3:
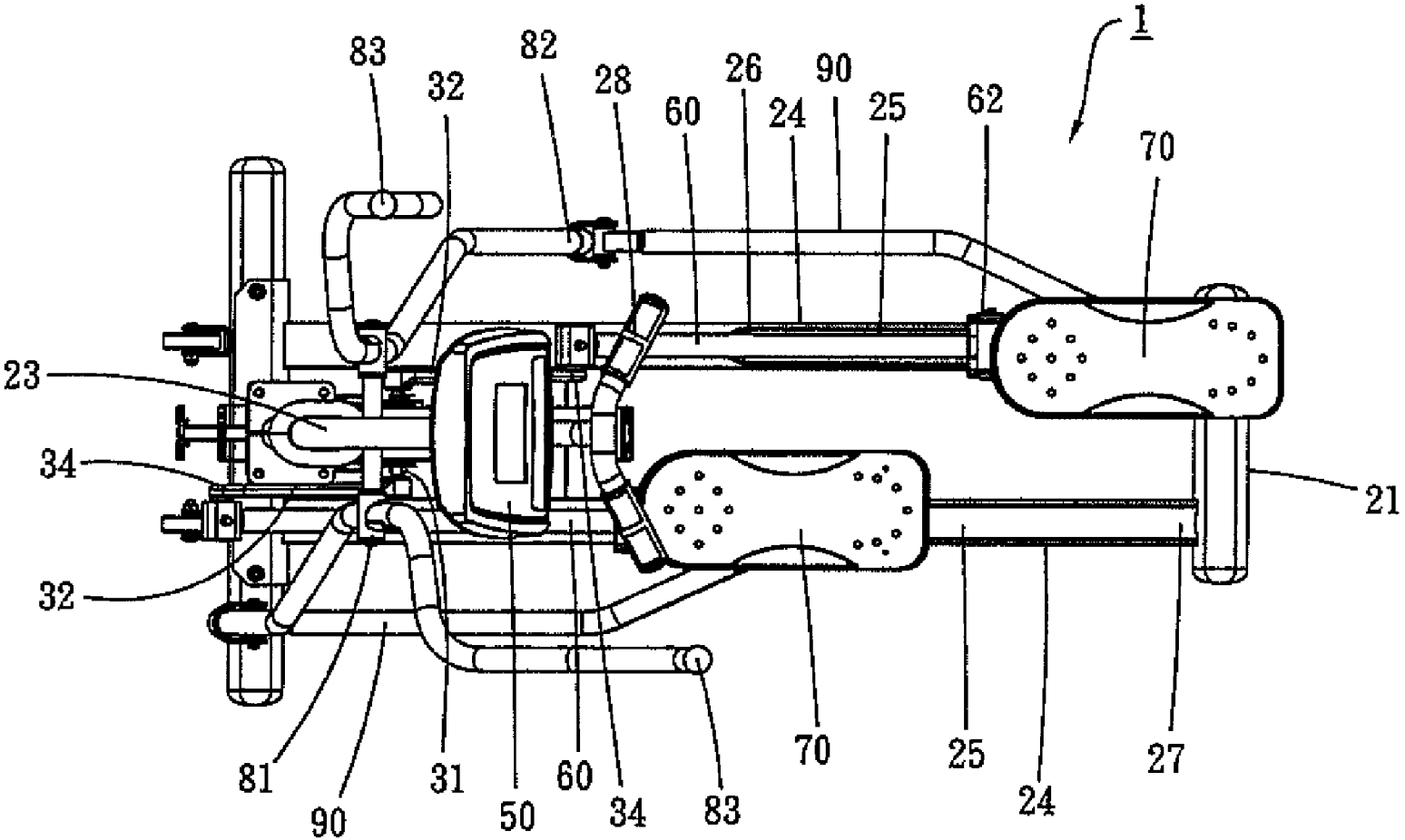
FIG. 3 is a top plan view of the first embodiment of FIG. 1 without the shroud.

Now referring to FIG. 2, the elliptical exercise apparatus 1 comprises a frame 20 which is composed of a base 21 resting on a ground surface, a frame support 22 mounted at a front end of the base 21, and a console mast 23 extending upwardly from the frame support 22.

Figure 4:
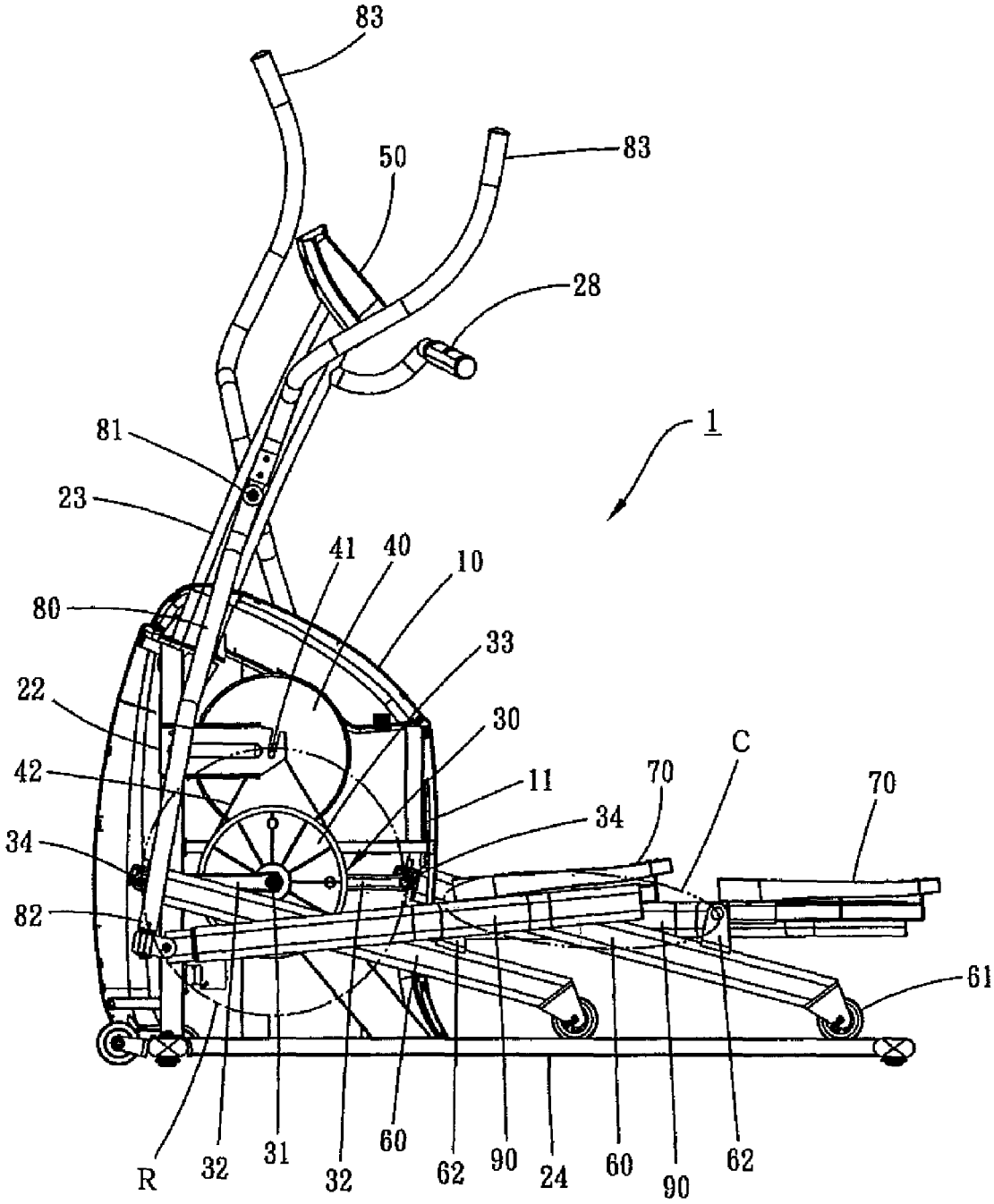
FIG. 4 is a left side view of the first embodiment of FIG. 1 without the left half shroud, and two pedals respectively are at a front end and a rear end within a movement area.

The frame support 22 includes a rotating assembly 30 which has a crank pivot 31, two crank arms 32 and a large pulley 33. The crank pivot 31 pivots to the frame support 22. The crank arms 32 are secured respectively and symmetrically to the opposite ends of the crank pivot 31, and there is an angular difference of 180 degrees between the two crank arms 32. The outer ends of the crank arms 32 form two connecting points 34. As shown in FIG. 4, each connecting point 34 moves along a circular path R. Now referring to FIG. 5, the bottom of the circular path R is very close to the ground. In other words, the outer end of the crank arm 32 is very close to the ground when the crank arm 32 rotates to a direction front to the ground. More specifically, the distance between the outer end of the crank arm 32 and the ground surface is less than 10 cm. The large pulley 33 locates between the two crank arms and coaxially pivots to the crank pivot 31.

The rotating assembly 30 further has a flywheel 40 mounted pivotally on the frame support 22. The diameter of the flywheel 40 is smaller than the diameter of the circular path R, and the rear edge of the flywheel 40 is in front of the rear edge of the circular path R. In other words, as shown in FIG. 4, the flywheel 40 is located on the motion boundary of the crank arm 32. A small pulley 41 is mounted on a left side of the flywheel 40 and positioned over the large pulley 33 of the rotating assembly 30. The flywheel 40 and the small pulley 41 are coaxial. A belt 42 connects the small pulley 41 and the large pulley 33, so that the flywheel 40 and the rotating assembly 30 can rotate simultaneously in a predetermined rotational speed ratio.

In addition, elliptical exercise apparatus 1 generally comprises an eddy-current brake (not shown) located near the flywheel 40. The eddy-current brake comprises a movable magnetic assembly, and a user can use the console 50 to adjust a distance between the flywheel 40 and the movable magnetic assembly for adjusting a rotating resistance of the flywheel 40.

Now referring to FIGS. 1 and 4, a shroud 10 is mounted around the frame support 22. The shroud 10 wraps the rotating assembly 30, the flywheel 40, the eddy-current brake, and the circuits for protecting the mechanism and the user. The front and rear portions of the shroud 10, as shown in FIG. 4, are very close to the front edge and the rear edge of the circular path R, and the rear portion has two parallel slots 11.

The base 21 of the frame 20 includes two rails 24 extending forwardly from the rear end of the frame. The top of the rear section of each rail 24 forms a track 25. The two connecting points 34 respectively connect to the two supporting rods 60. Each supporting rod 60 has a front end connected pivotally to an outer side of the outer end of each of the crank arm 32, a middle portion passing through the slot 11 of the shroud 10, and a rear end provided with a respective roller 61 which moves back and forth on the corresponding longitudinal track 25. When the front ends of the supporting rods 60 move along the circular path R, the rear ends move correspondingly along the track 25 between a front point 26 and a rear point 27. Due to the angular difference of 180 degrees between the front ends of the supporting rods 60, the rear ends of the supporting rods will move in an opposite direction.

Figure 5:
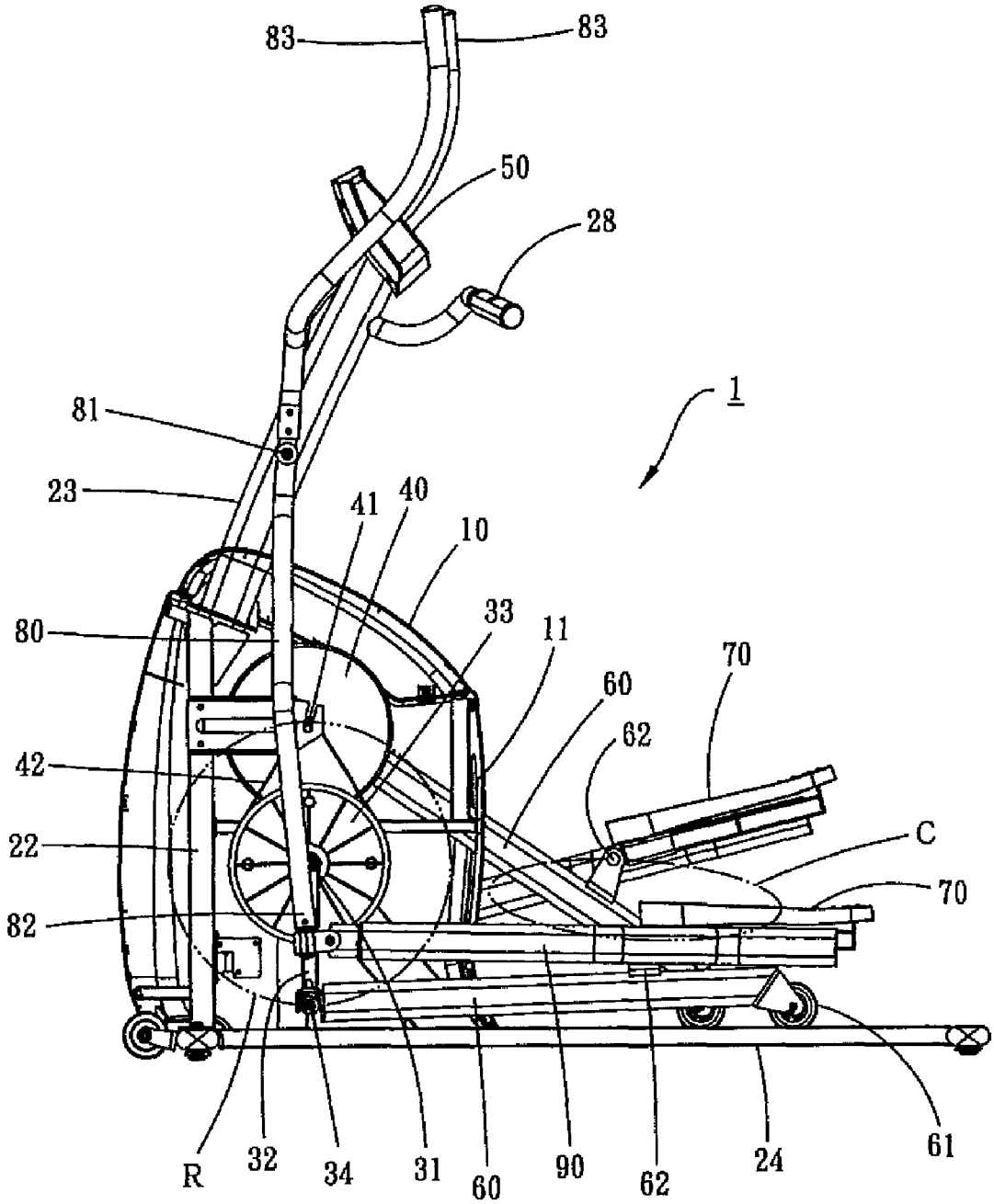
FIG. 5 is a left side view of the first embodiment of FIG. 4, and the two pedals respectively are at a higher end and a lower end in the movement area.
Figure 6:
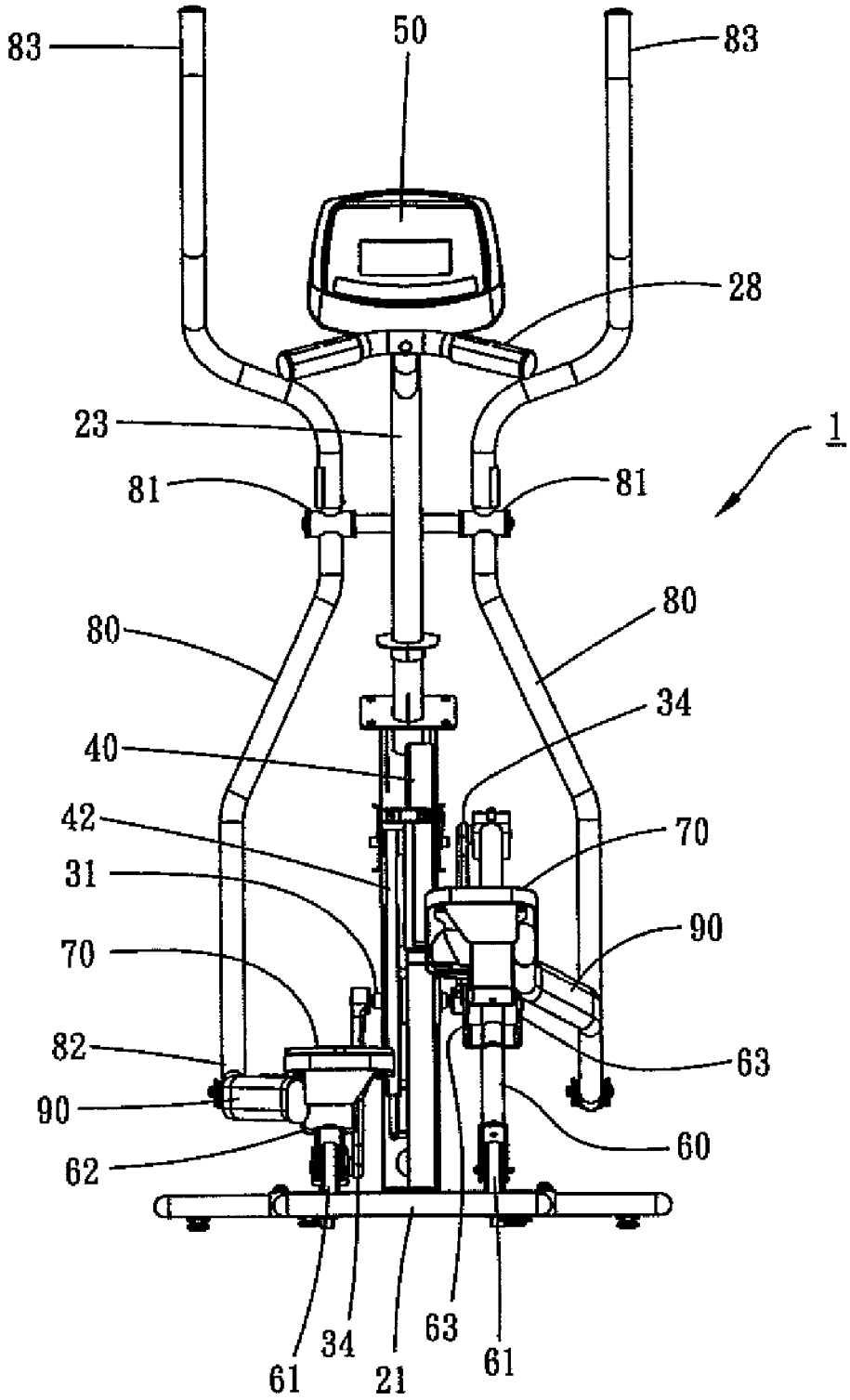
FIG. 6 is a front view of the first embodiment of FIG. 5.

The distance between the front and rear ends of the supporting rods 60 is greater than the diameter of the circular path R and smaller than two times the diameter of the circular path R. Each supporting rod 60 includes a supporting member 62 locating between the rear end and the middle of the supporting rod 60. Each supporting member 62 has two opposite fixed plates 63 (as shown in FIG. 6). Referring to FIGS. 4 and 5, the front ends are restricted to the circular motion and rear ends are restricted to the back and forth motion, so the supporting member 62 moves along a substantial elliptical closed path C. The long axis of the elliptical closed path C substantially corresponds to the longitudinal axis of the elliptical exercise apparatus, and the short axis of the elliptical closed path C substantially corresponds to the vertical axis of the elliptical exercise apparatus. The front end of the closed path C is very close to the rear end of the circular path R. Specifically, the horizontal distance between the closed path C and the circular path R is less than 20 cm, and the supporting member 62 is very close to the rear portion of the shroud 10 when it moves to the front end of the range of the motion.

Left and right pedals 70 for a user to stand on are respectively mounted on the supporting rods 60. Each pedal 70 has a front end corresponding to the user's toes and a rear end corresponding to the user's heel, and is mounted pivotally between the fixed plates 63 of the supporting member 62 of the supporting rod 60, so that the front end of each pedal 70 moves along the closed path C, and the pedal 70 moves relative to the supporting rod 60.

Left and right swing arms 80 are mounted respectively on the left and right sides of the frame 20 and extend substantially longitudinally. Each swing arm 80 includes a pivot point 81 formed at the middle section, a swing end 82 formed at the bottom end for swinging back and forth, and a handle 83 formed at the top end for a user to grip. The swing arms 80 are rotatably connected to the console mast 23 of the frame 20 through their respective pivot points 81.

The swing end 82 of each swing arm 80 is connected to a link 90. Each link 90 has a front end connected pivotally to the swing end 82 for restricting to move along an arcuate path, and a rear end secured to a respective outer side of the pedal 70. So that the supporting rod 60 and the swing arms 80 are driven by each other via the link 90. When the link 90 moves, the angle between the link 90 and the supporting rod 60 will vary with the angle between the pedal 70 and the supporting rod 60.

During the use of the elliptical exercise apparatus 1, the user stands on the left and right pedals 70 and grips the left and right handles 83. The user imparts force to the pedals 70 and the handles 83, thereby causing the motions of the supporting rods 60, the rotating assembly 30, the links 90, and the swing arms 80, so that the pedals 70 travel along a substantial elliptical path. Left and right handles 83 move respectively along an arcuate path in the opposite directions. In the same way, when one pedal 70 moves forward, the other pedal 70 moves rearward. And each handle 83 moves forward as its respective pedal 70 moves rearward, and vice versa. The user has an option to grip the handlebar 28 at the top of the console mast 23 to exercise his lower body only.

A user can adjust the resistance of the pedals 70 and the handles 83 by adjusting the resistance of the flywheel 40 via the console 50 described above.

During the operation period, while the pedal 70 moves along a downward and backward segment, as the left pedal 70 shown in FIG. 5 or the right pedal 70 shown in FIG. 4, the upper surface of the pedal is substantially horizontal. When the pedal 70 moves along the other segments of the motion path, the front end of the top of the pedal 70 will lower than the rear end of the top of the pedal 70, and it is apparent when the pedal 70 is at the top of the motion path. The angular variation of the pedal conforms with the angular variation of the sole of a person's foot. Therefore a user feels comfortable and his legs may not ache or hurt easily while using the elliptical exercise apparatus 1 according to this invention.

As most clearly shown in FIGS. 4-5, the rear end of each supporting rod 60 is always under the corresponding pedal. As described above, the rear end of each supporting rod 60 moves back and forth between a front point 26 and a rear point 27 (as shown in FIG. 2). So that the front point 26 is not closer to the front region of the frame 20 than the front edge of the motion path of the front end of pedal 70, i.e. the closed path C, and the rear point 27 is not closer to the rear region of the frame than the rear edge of the motion path (not shown) of the rear end of the pedal 70. In other words, in the longitudinal direction, the front point 26 of the track 25 aligns transversely or is in back of the front edge of the closed path C of the front ends of the pedals 70, and the rear point 27 of the track 25 aligns transversely or is in front of the rear edge of the closed path C of the rear ends of the pedals 70.

As shown in FIG. 4, the position of the pivot point 81 is substantially over the center of the circular path R, and the longitudinal positions of the front end of the arcuate path of swing end 82 and the front edge of the circular path R are substantially the same. More specifically, the preferred distance between the front end of the arcuate path and the front edge of the circular path R is less than 10 cm. Therefore, during the use of the elliptical exercise apparatus, neither the bottom ends of the swing arm 80 nor the handles 83 of the swing arms 80 will be in front of the shroud 10.

As the figures and described above, the longitudinal length of the elliptical exercise apparatus 1 is substantial equal to the longitudinal length of the motion range of the crank arm 32 plus the longitudinal length of the motion range of the pedal 70. Compared with conventional elliptical exercise apparatuses, the elliptical exercise apparatus 1 of this invention not only provides an adequate travel of the pedals with ergonomic benefits, but also reduces the occupied space. So to a home user who has a limited indoor space, it is easy to place the exercise apparatus at the corner or to move it. To distributors or fitness centers, more exercise apparatuses can be displayed in the same area. To the manufacturers, size reducing can increase the stock density and reduce the production cost.

Figure 7:
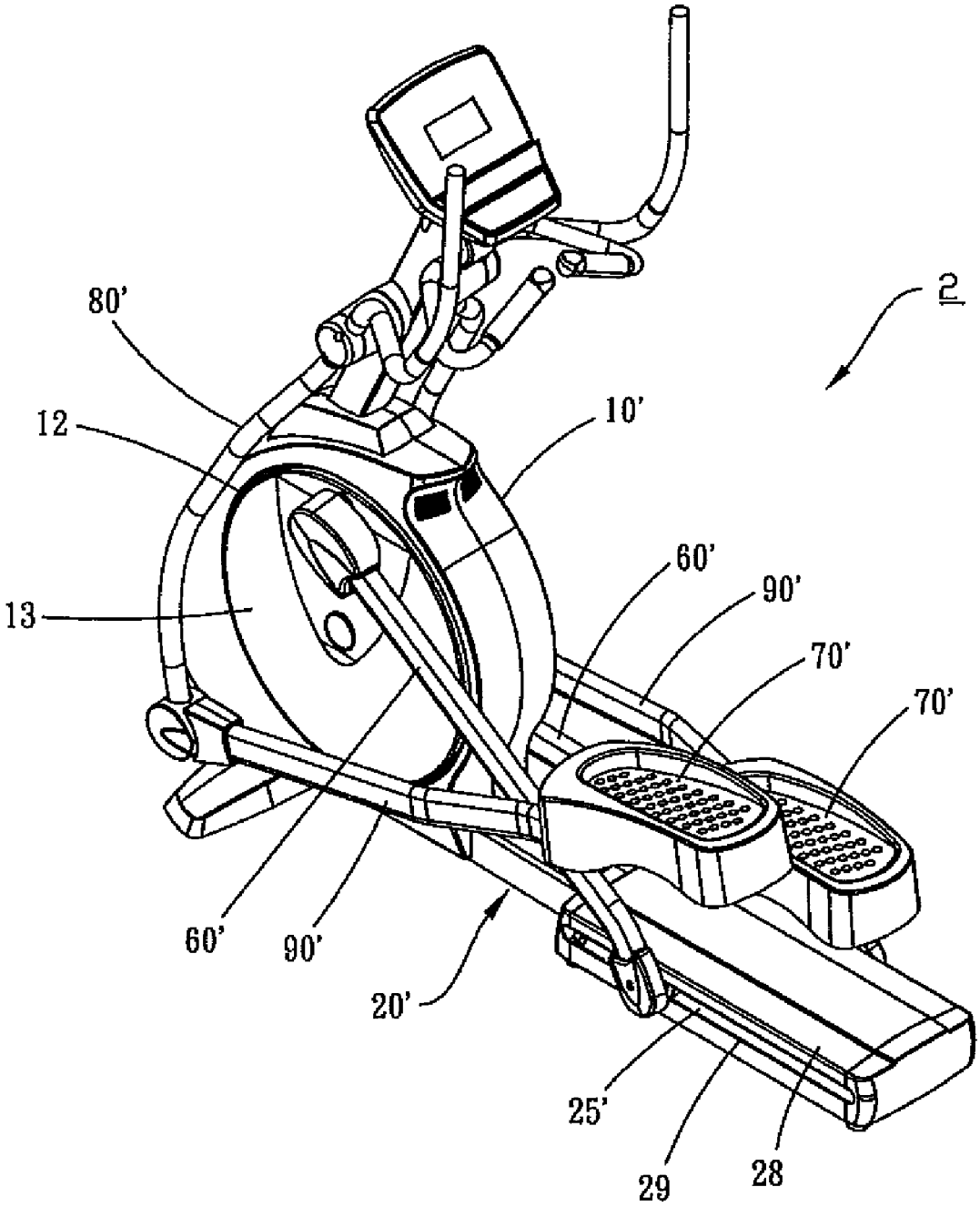
FIG. 7 is a perspective view of a second embodiment.
Figure 8:
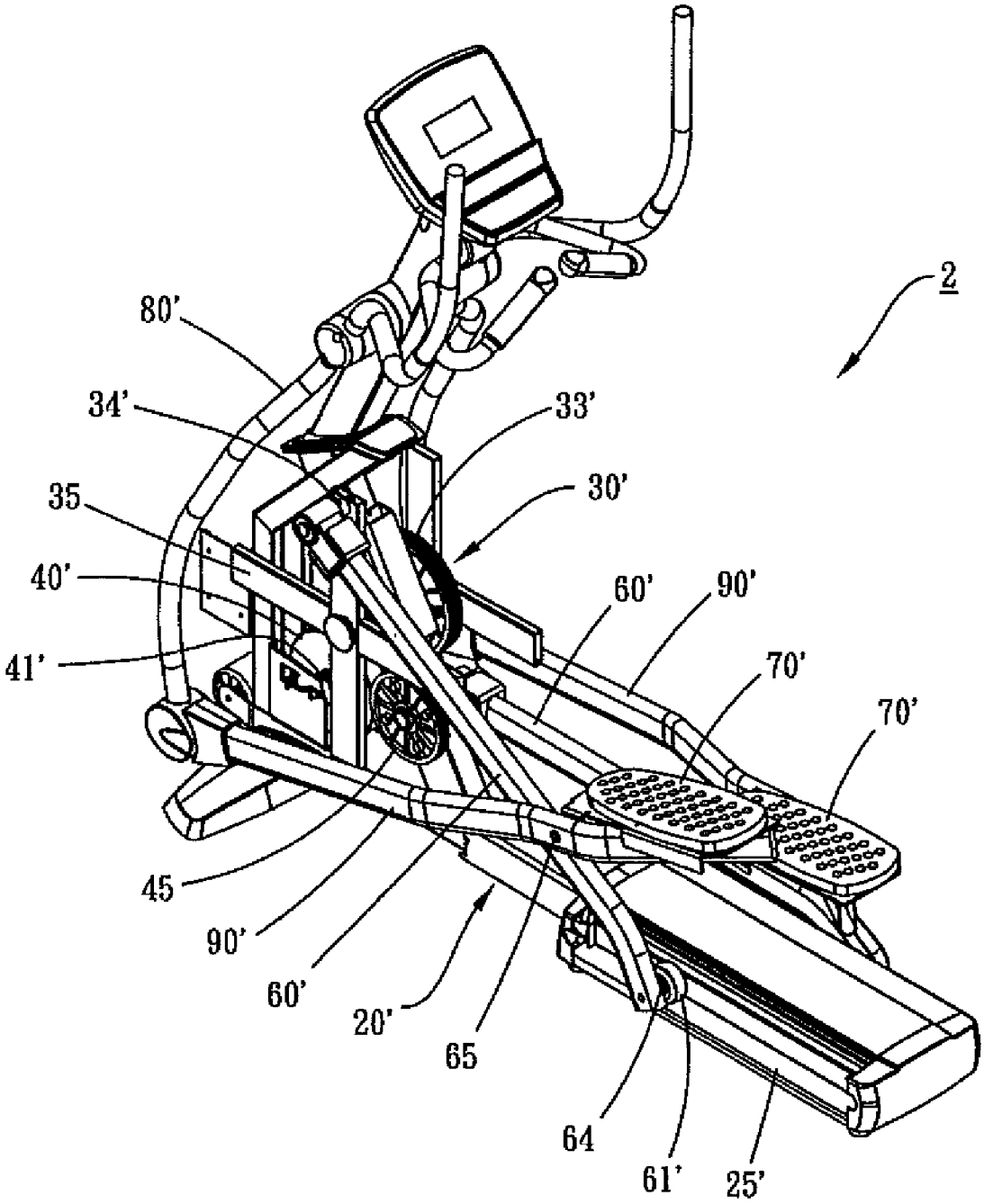
FIG. 8 is a perspective view of the second embodiment of FIG. 7 without some parts.
Figure 9:
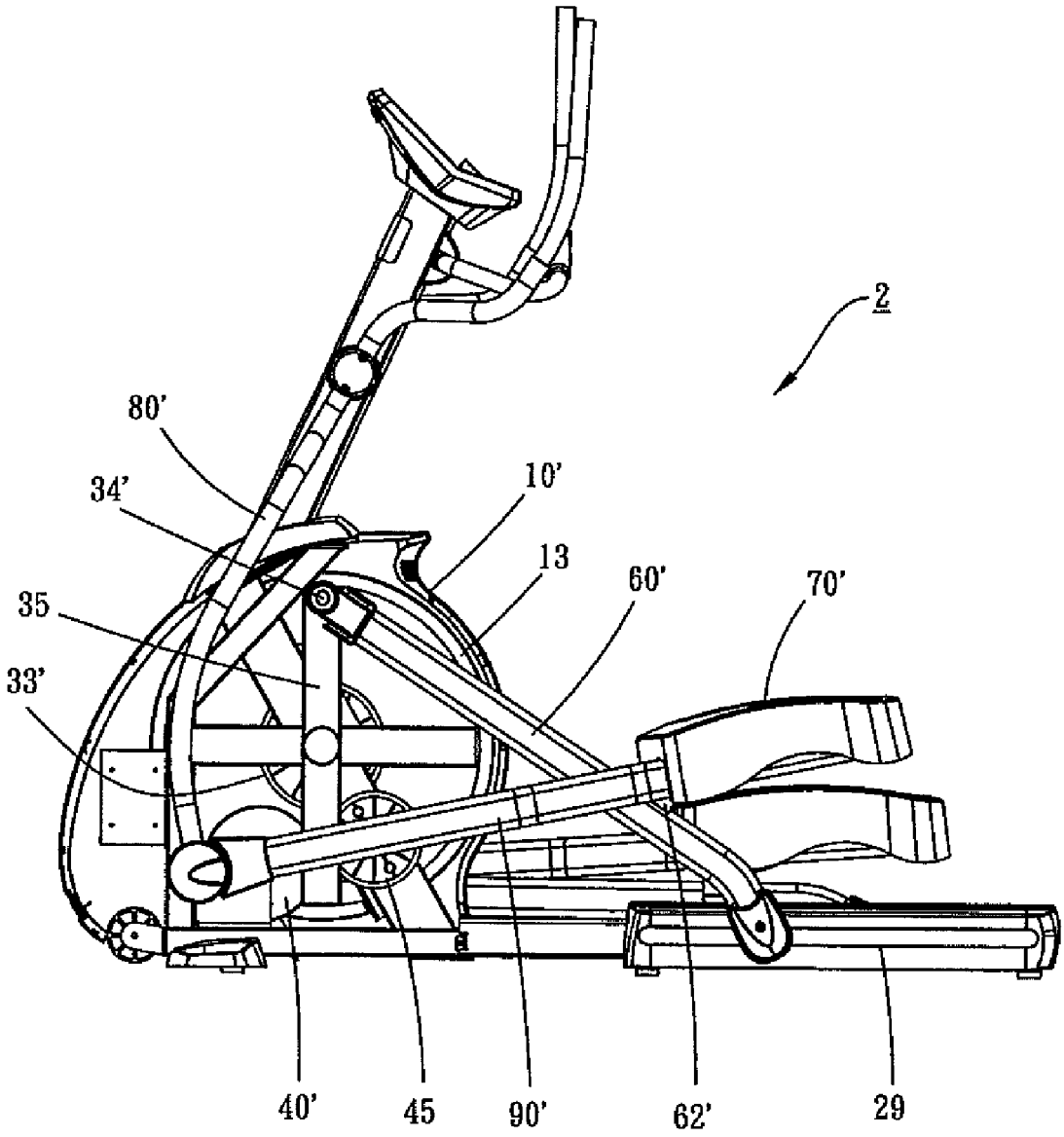
FIG. 9 is a left side view of the second embodiment of FIG. 7 without a left half shroud.

A second embodiment according to the present invention is illustrated in FIGS. 7-9. This embodiment also includes the advantages described above, and the members and the relationships therebetween of this embodiment are substantial the same with those of the first embodiment. The different features will be described below.

As shown in FIGS. 7-9, a rotating assembly 30' includes two opposite cranks 35 which are in the shape of a cross. An outer end of a branch of each crank forms a connecting point 34'. A shroud 10' wraps the rotating assembly 30' in the front region of the frame 20' and has two round openings 12 corresponding to the left side and a right side of the cranks 35. Two round plates 13 are attached respectively to the cranks 35 beside the round openings 12. Respectively, the front ends of the supporting rods 60' are connected pivotally to the connecting point 34' outside the round plates 13. In this embodiment, the width of the shroud 10' is narrower than that in the embodiment described above.

Left and right tracks 25' which extend longitudinally are mounted on the rear end of the base of the frame 20'. The tracks 25' are under a cover 28' and on two opposite sides of the cover 28'. The rear ends of the supporting rods 60' move outside the cover 28'. Two roller pivots 64 each passes through a slot 29 on the side of the cover 28' and has two opposite ends. One end is connected to the rear end of supporting rod 60', and the other end is connected to a corresponding roller 61' within the cover 28'. So the rollers 61' can travel on the tracks 25' and are protected by the cover 28'.

In the embodiment, the flywheel 40' is smaller than that in the previous embodiment, and the position of the flywheel 40' is lower than the rotating assembly 30', so that the shroud 10' is close to the rotating assembly 30'. A medium pulley set 45 is coupled pivotally within the shroud 10' and composed of a large wheel and a small wheel. The large pulley 33' of the rotating assembly 30' connects with the small wheel of the medium pulley set 45 via a belt, and the large wheel of the medium pulley set 45 connects with the small pulley 41' of the flywheel 40' via another belt (not shown), so that the transmission can be completed in a limited space.

In the first embodiment, the pedals 70 are mounted pivotally respectively on the supporting rods 60 and connected to the links 90, and the links 90 are not connected to the supporting rods 60 directly. In the second embodiment, the front ends of the pedals 70' are also mounted pivotally respectively on the supporting member 62' of the supporting rods 60'. The main difference between the first and second embodiments is the links 90 are connected respectively to the supporting members 62' through the axis 65. The rear ends of the links 90 respectively curve inward to the bottom of the pedals 70' for fixing thereon, so that the pedals 70' are mounted more stably on the supporting rods 60'.

The other parts in this second embodiment, such as the relationships or the distances between the members, and scale of the members are all the same with those in the first embodiment. The elliptical exercise apparatus 2 provides the complete travel of the pedals with ergonomic benefits and save space, too. Compared with the first embodiment, the shroud 10' in this second embodiment is lower and narrower.

FIGS. 10 to 17 illustrate an elliptical exercise apparatus 300 of a third embodiment of the invention. The elliptical exercise apparatus 300 also has the compact advantages as discussed in the earlier embodiments. Moreover, the third embodiment provides an additional function for a user to fold the elliptical exercise apparatus 300 in a convenient way without complicating the structure. The elliptical exercise apparatus 300 remains compact after folding, while having an even smaller footprint when in the folded state.

Most structures and mechanical relationships therebetween of the third embodiment are substantially the same as in the previous embodiments. In order to prevent redundant or duplicate descriptions, some mechanical parts which are important, but which have the same function in all embodiments will not be described in detail hereinafter.

Figure 10:
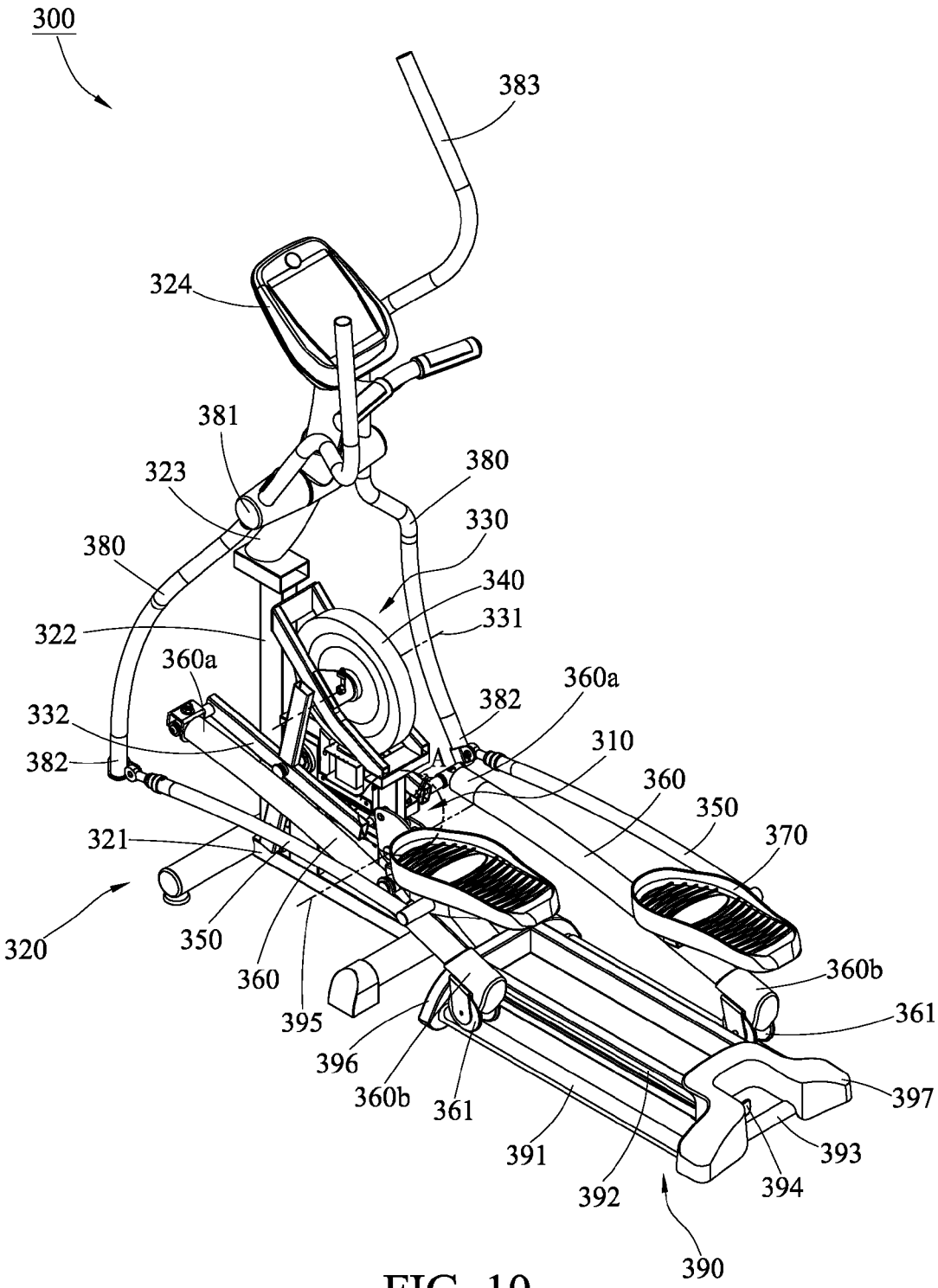
FIG. 10 is a perspective view of a third embodiment.

Referring to FIG. 10, the elliptical exercise apparatus 300 substantially includes a frame 320 for supporting on a ground surface, a rotating assembly 330 pivotally coupled to the frame 320, a guider frame 390 positioned behind the frame 320 and operably connected to the frame 320 about a first axis 395, left and right supporting rods 360 respectively interconnected between the rotating assembly 330 and the guider frame 390, left and right pedals 370 respectively coupled to the left and right supporting rods 360, left and right swing arms 380 pivotally coupled to the frame 320 for swinging fore and aft, and left and right links 350 respectively interconnected between the left and right swing arms 380 and left and right supporting rods 360.

The frame 320 has a base 321 for stably supporting on the ground surface. The frame 320 further includes a frame support 322 mounted on the base 321 for assembling other mechanical parts, and a console mast 323 extending upwardly from the top of the frame support 322. Additionally, there is a console 324 mounted on the top of the console mast 323 for a user to control the elliptical exercise apparatus 300.

Figure 11:
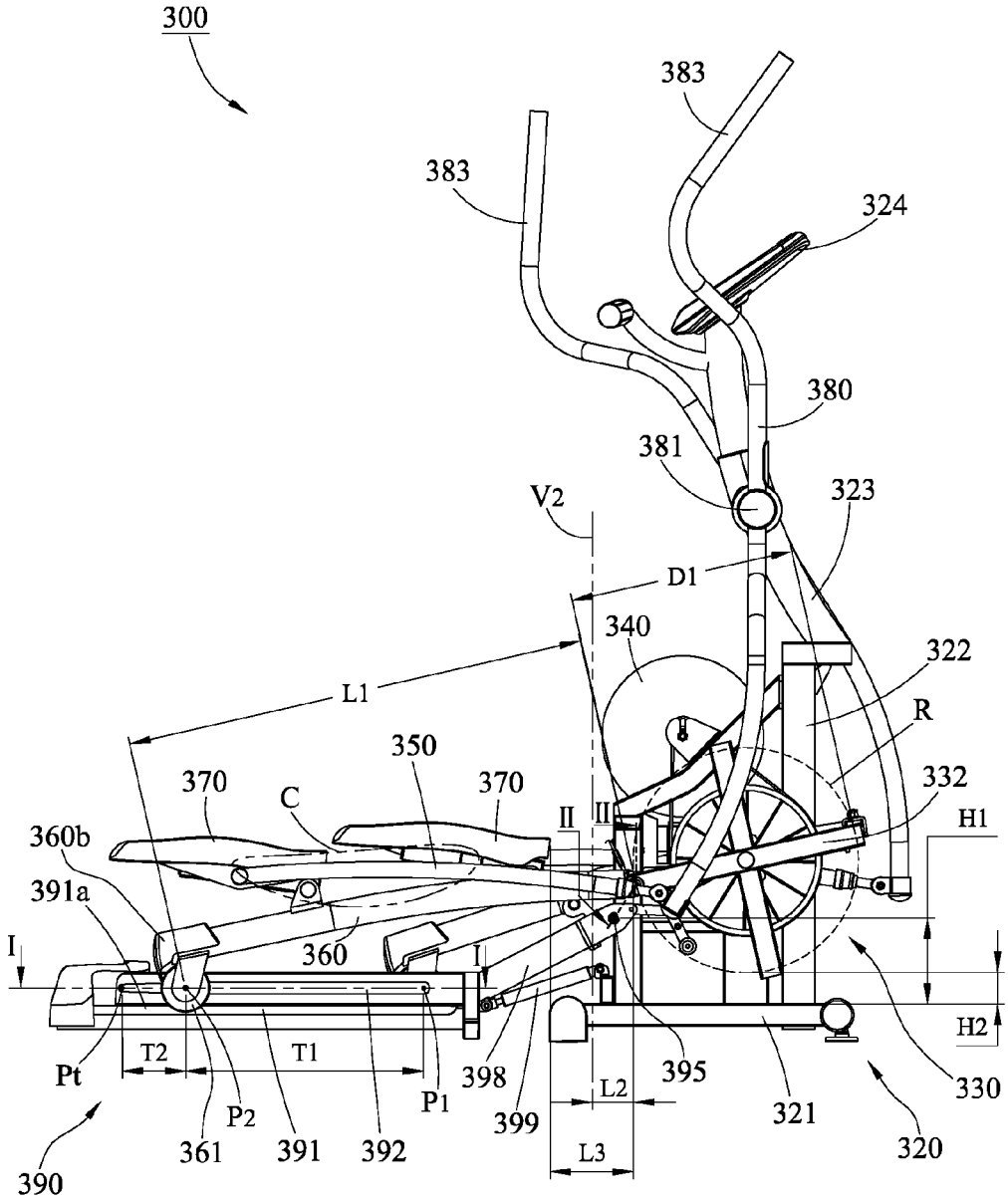
FIG. 11 is a right side view of FIG. 10.

Referring to FIGS. 10 and 11, the rotating assembly 330 has two crank arms 332 respectively pivotally rotatable about a crank axis 331 on the frame support 322 of the frame 320 on the left and right sides of the elliptical exercise apparatus 300. Thus, the crank arms 332 define a circular path R as they are rotated about the crank axis 331. The rotating assembly 330 further includes a resistance member 340, such as a flywheel and an eddy current brake, and several pulleys and belts disposed in a predetermined gear ratio on the frame support 322 for transporting energy. Some possible embodiments may be equipped with self-power mechanisms (not shown), such as a combination of generator and an electromagnetic braking member as known by people skilled in the art.

Figure 13:
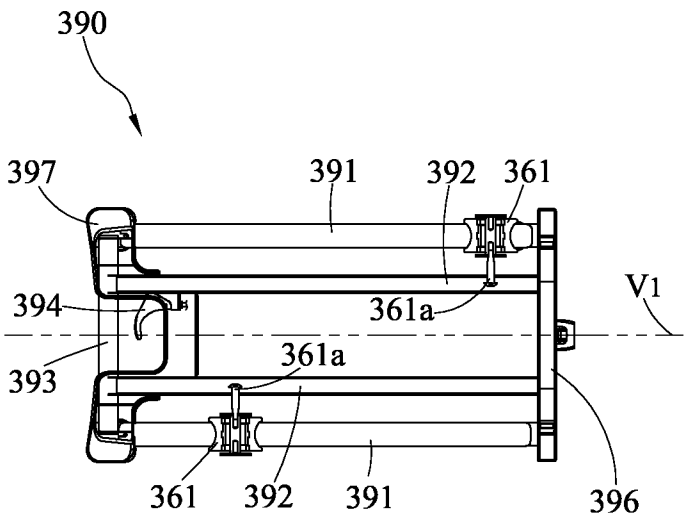
FIG. 13 is a cutaway view about the I-I axis in FIG. 11.
Figure 12:
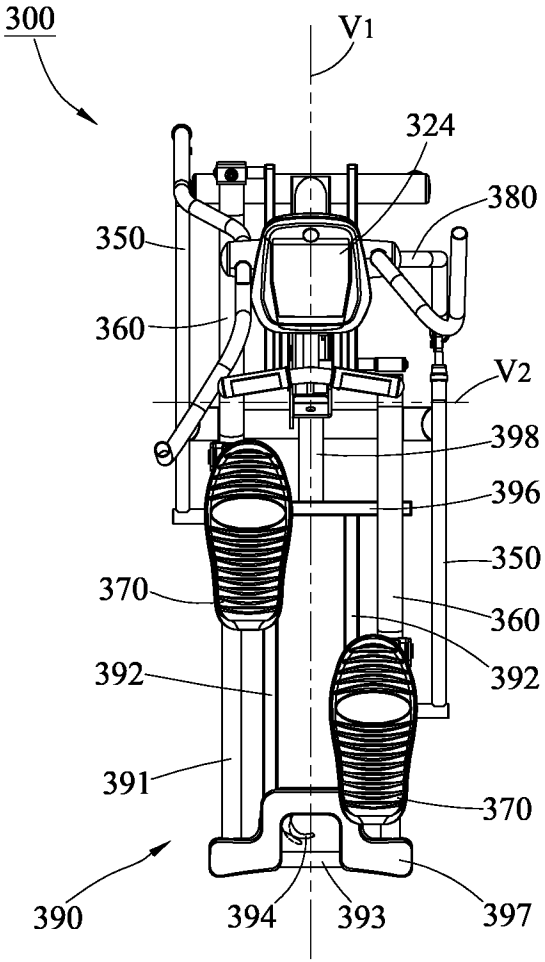
FIG. 12 is a top view of FIG. 10.

Referring to FIGS. 10, 11, and 13, the shape of the guider frame 390 is substantially like a rectangle. The guider frame 390 is composed of left and right tracks 391, a front member 396, and a rear member 397. The guider frame 390 also includes left and right slots 392 located within the rectangle shape. The tracks 391 and slots 392 are arranged longitudinally and parallel to each other. The guider frame 390 further includes an arm 398 extending forward from the front member 396. The arm 398 of the guider frame 390 is pivotally mounted to the rear portion of the frame support 322 of the frame 320 about a laterally disposed first axis 395. As shown in FIG. 12, the frame 320 defines a longitudinal centerline V1. The longitudinal centerline V1 divides the elliptical exercise apparatus 300 into two substantially equal parts. There is a vertical plane V2 perpendicular to the longitudinal centerline V1. Referring to FIG. 11, the vertical plane V2 is laterally disposed and located between the pedals 370 and the rear edge of the circular path R. More specifically, a distance L2 between the vertical plane V2 and the rear edge of the circular path R is about 10 cm in the third embodiment. The vertical plane V2 divides the elliptical exercise apparatus 300 into a front portion which substantially has the rotating assembly 330, the frame support 322 of the frame 320, and the console 324 and a rear portion which substantially has the guider frame 390. The first axis 395 is located in the front portion of the elliptical exercise apparatus 300. The first axis 395 is also located at a height H1 relative to a top surface of the base 321 of the frame 320. The height H1 is high than the bottom edge of the circular path R.

The rear member 397 of the guider frame 390 has a gripping bar 393. A user can grasp the gripping bar 393 to lower the guider frame 390 down to a use position, or to lift up the guider frame 390 up into a storage position, as respectively depicted in FIGS. 11 and 16. When the guider frame 390 is lowered down to touch the ground surface, i.e. the guider frame 390 is in the use position, the guider frame 390 of the third embodiment equivalently acts as the rails 24 of the previous embodiments as shown in FIG. 1. Similar to the previous embodiments, the bottom edge of the circular path R is very close to the base 321 of the frame 320. In the third embodiment, the top surface of the base 321 of the frame 320 and the top surface of the tracks 391 are substantially at the same level. A height H2 between the bottom edge of the circular path R and the track 391 when the elliptical exercise apparatus 300 is in the use position is shorter than 10 cm in the third embodiment. When the guider frame 390 is in the storage position, the elliptical exercise apparatus 300 is folded to save space. Using the geometry described herein for the guider frame 390 and the location of the first axis 395, the elliptical exercise apparatus 300 of the third embodiment can be folded in a convenient way to significantly reduce the footprint area without resorting to complicated structures or complex mechanisms as used on prior folding elliptical exercise apparatus.

Figure 14A:
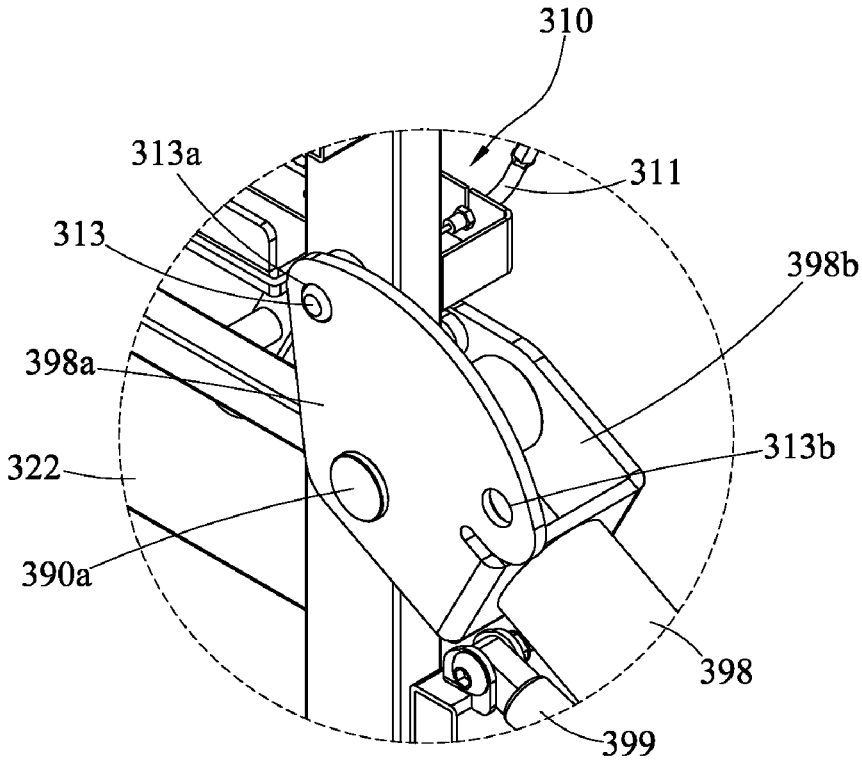
FIG. 14*a* is an enlarged view of the area A in FIG. 10.
Figure 14B:
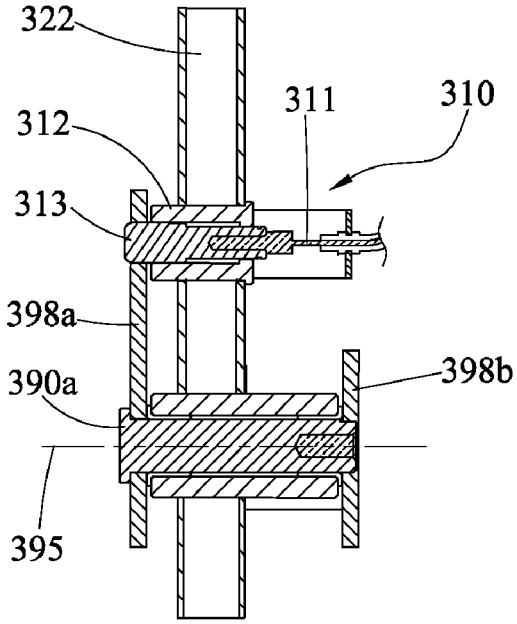
FIG. 14*b* is a cutaway view about the II-II line in FIG. 11.

Referring to FIGS. 10 and 14*a* and 14*b*, the arm 398 of the guider frame 390 further includes left plate 398*a* and right plate 398*b* which are mounted parallel to each other on the front of the arm 398. The left plate 398*a* and right plate 398*b* are clipped to the rear portion of the frame support 322 of the frame 320. An axle 390*a* of the first axis 395 is penetrated through the left plate 398*a*, the frame support 322, and the right plate 398*b*. The left plate 398*a* is fan-shaped with the first axis 395 located at the vertex of the fan. Two holes, located equidistant from the first axis 395 and positioned near the outer edge of the left plate 398*a*, penetrate the left plate 398*a* to form a first locking hole 313*a* and a second locking hole 313*b* as illustrated in FIG. 14*a*. The first locking hole 313*a* and the second locking hole 313*b* have an included angle of about ninety degrees centered at the first axis 395. A locking mechanism 310 is disposed at a position on the frame support 322 corresponding to the position of the first and second locking holes 313*a*/313*b*. The locking mechanism 310 includes a cylindrical housing 312, a first pin 313, and a steel cable 311 attached to the first pin 313 at a near end. The first pin 313 is coaxially arranged within the cylindrical housing 312 with the far end of the first pin 313 extending outside of the cylindrical housing 312. A user can control the axial position of the first pin 313 by pulling the steel cable 310 to retract the first pin 313 within the cylindrical housing 312, and by pushing or possibly releasing the steel cable 310 to extend the first pin 313 outside of the cylindrical housing 312. When the guider frame 390 is rotated to the use position, the first locking hole 313*a* aligns with the first pin 313, and extending the first pin 313 outside of the cylindrical housing 312 causes the first pin 313 to penetrate through the left plate 398*a* to engage with the first locking hole 313*a*. When the guider frame 390 is rotated to the storage position, the second locking hole 313*b* aligns with the first pin 313, and extending the first pin 313 outside of the cylindrical housing 312 causes the first pin 313 to penetrate through the left plate 398*a* to engage with the second locking hole 313*b*. Therefore, the guilder frame 390 can be locked in the use position or the storage position. In other possible embodiments, a locking mechanism may further include a compressed spring (not shown) used to bias a first pin toward an extended position.

As illustrated in FIG. 12, there is a switch 394 coupled to the rear member 397 of the guider frame 390. The steel cable 311 is interconnected between the first pin 313 of the locking mechanism 310 and the switch 394. When the first pin 313 is extended into a locking position to fix the elliptical exercise apparatus 300, such as in the use position as shown in FIG. 11, the switch 394 is pulled by the steel cable 311 into a first position. When the user pulls the switch 394 into a second position (as shown in dotted lines in FIG. 12), the steel cable 311 retracts the first pin 313 out of the first locking hole 313*a*, disengaging the locking mechanism 310 and decoupling the guider frame 390 from the frame support 322, thereby allowing the guider frame 390 to be freely rotated up.

Referring to FIG. 10, each of the left and right supporting rods 360 has a front end 360*a* and a rear end 360*b*. The front ends 360*a* of the left and right supporting rods 360 are respectively coupled to the distal ends of the crank arms 332 for moving along the circular path R. Each of the rear ends 360*b* of the left and right supporting rods 360 is connected to a roller 361. The rollers 361 are respectively engaged with the left and right tracks 391 of the guider frame 390. Thus, the rear ends 360*b* of the left and right supporting rods 360 can perform a reciprocating movement along a reciprocating path of length T1 located between a front point P1 and a rear point P2 along the tracks 391 of the guider frame 390, as illustrated in FIG. 11. The length between the front point P1 and the rear point P2 defines a minimum requirement for the length of the tracks 391 of the guider frame 390. That is, the tracks 391 must have a length equal to or greater than the length T1 of the reciprocating path to accommodate a complete reciprocating movement. However, each of the tracks 391 further has a supplemental section 391*a* rearward the rear point P2 in the third embodiment. The supplemental sections 391*a* are used to support the rear ends 360*b* of the supporting rods 360 when the guider frame 390 is folded up into the storage position. As shown in FIG. 11, the length L1 of the supporting rod 360 is approximately twice the diameter D1 of the circular path R. It still has the same compact features as the supporting rods of previous embodiments. Left and right pedals 370 are respectively coupled to the left and right supporting rods 360 and the left and right pedals 370 are located over the corresponding rear ends 360*b* of the left and right supporting rods 360. When the left and right supporting rods 360 are moved, the left and right pedals 370 are driven to move along an arcuate closed path C as depicted in FIG. 11. As in the previous embodiments, the left and right pedals 370 of the third embodiment regularly change attitude during the exercise in order to better conform to the natural position and orientation of the feet and ankles of the user. FIG. 11 shows the left pedal 370 located at the foremost position of the arcuate closed path C. A distance L3 is shown between the front distal end of the left pedal 370 and the rear edge of the circular path R. The distance L3 is approximately 20 cm in the third embodiment of the invention, as shown in FIG. 11.

As in the previous embodiments, the left and right swing arms 380 have handles 383 and swing ends 382 and are respectively pivoted to the left and right side of the frame 320 via corresponding pivot points 381 thereof which are located between the handles 383 and the swing ends 382. A user can grip the handles 383 of the left and right swing arms 380 to pull or push the swing arms 380, and the swing ends 382 thereof are moved fore and aft relative to the corresponding handles 383. Each of the left and right links 350 has a front end pivotally connected to the corresponding swing end 382 of the swing arm 380. Rear ends of the left and right links 350 are connected to the corresponding left and right supporting pedals 370.

Figure 15:
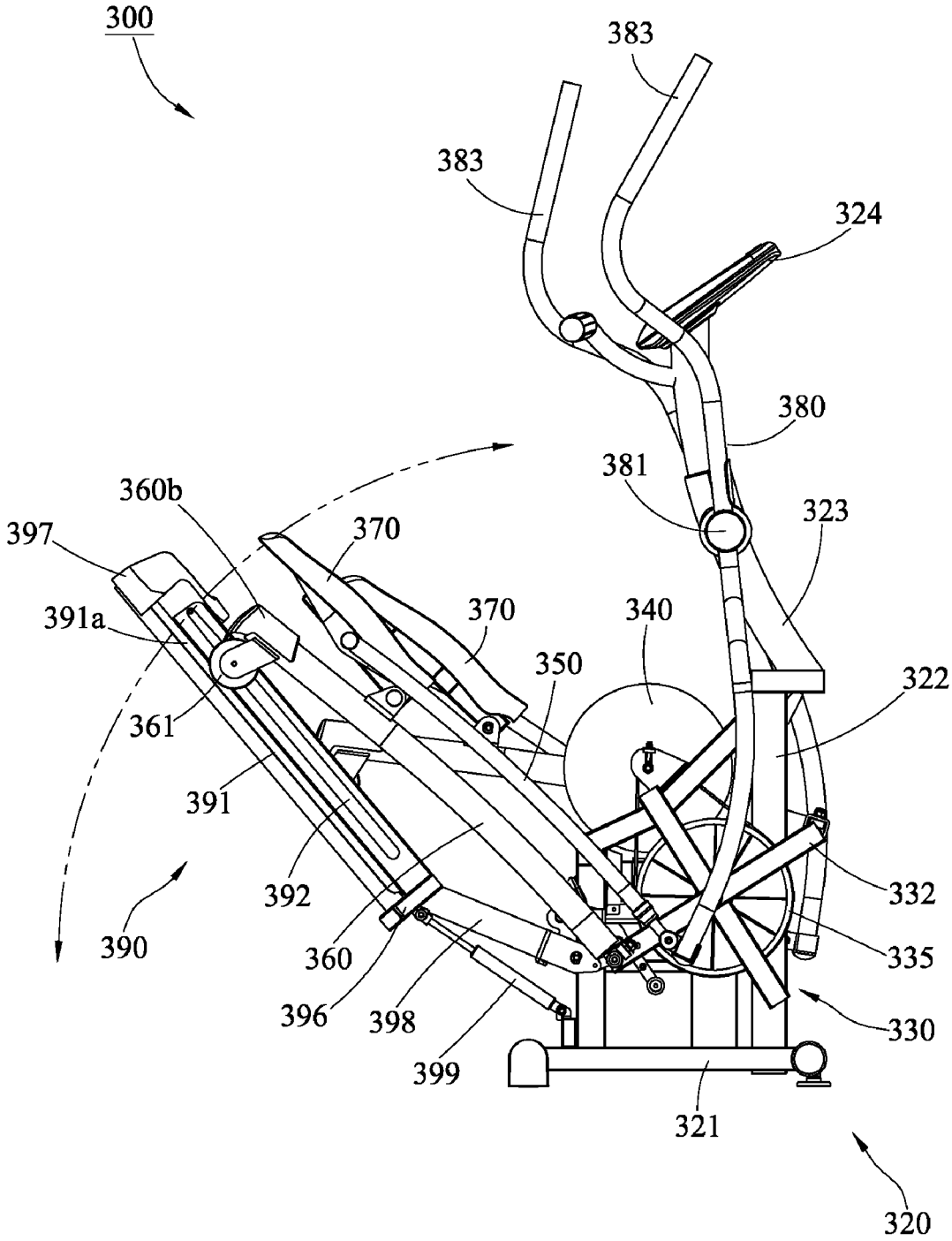
FIG. 15 is another right side view of FIG. 10 illustrating the elliptical exercise apparatus in a partially folded state.
Figure 16:
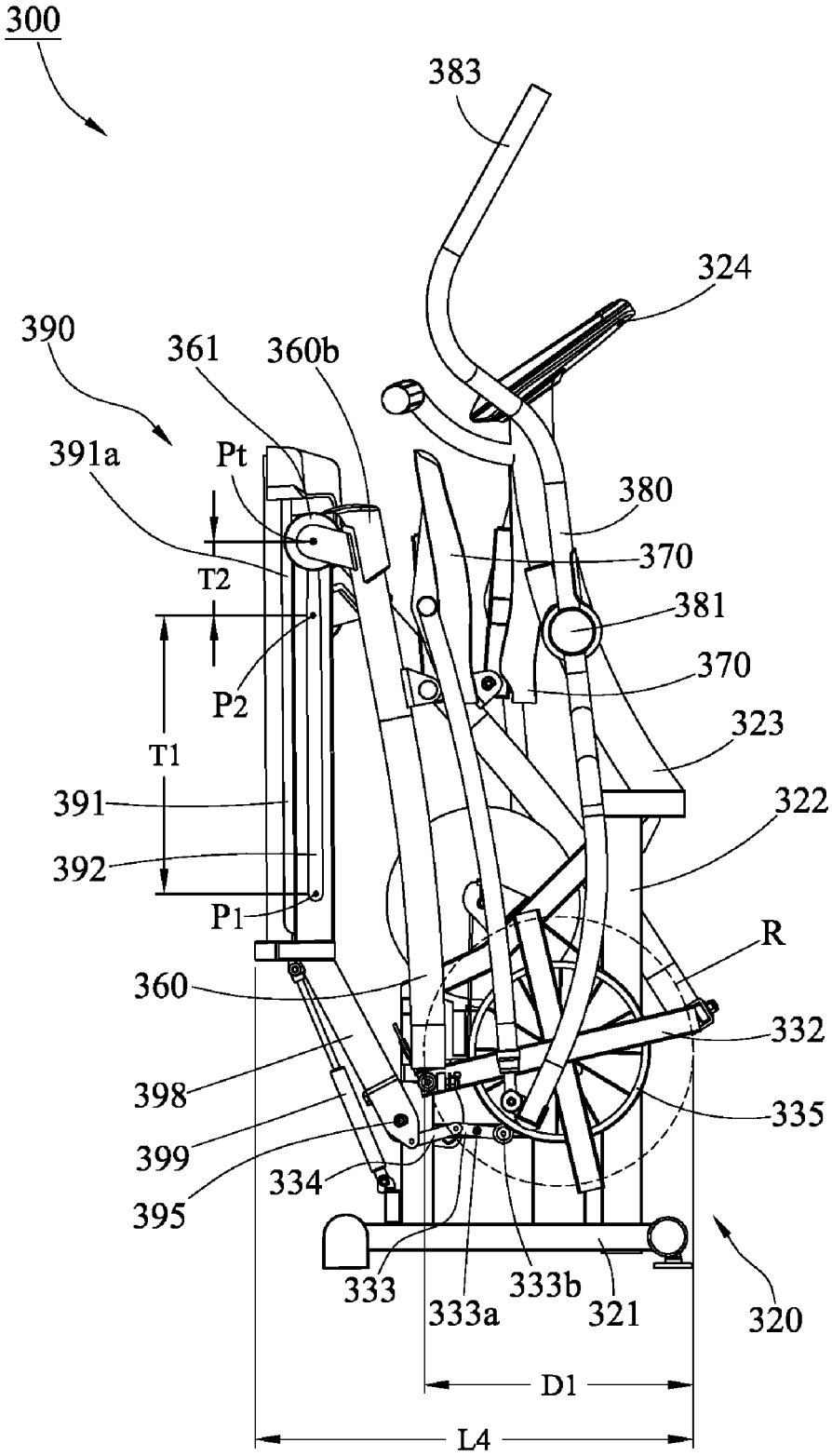
FIG. 16 is another right side view of FIG. 10 illustrating the elliptical exercise apparatus in a storage position.

When a user needs to store the elliptical exercise apparatus 300, he/she can fold the elliptical exercise apparatus 300 of the third embodiment into a folded state, as depicted in FIG. 16. The folding process involves: (a) standing near the rear portion of the elliptical exercise apparatus 300; (b) stooping down to grasp the gripping bar 393 of the guider frame 390 and pulling the switch 394 to disengage the locking mechanism 310; and (c) lifting the guider frame 390 upward as illustrated in FIG. 15 until the guider frame 390 is positioned in the storage position as illustrated in FIG. 16, and releasing the switch 394 to reengage the locking mechanism 310 so as to lock the guider frame 390 into the storage position. During the folding process, the left and right supporting rods 360 maintain contact with the guider frame 390.

Conversely, the unfolding process involves: (a) standing near the rear portion of the elliptical exercise apparatus 300 which had been folded into the storage position as depicted in FIG. 16; (b) grasping the gripping bar 393 and pulling the switch 394 to disengage the locking mechanism 310; and (c) pulling the guider frame 390 backward and downward as illustrated in FIG. 15 until the guider frame 390 rests on the ground surface such that the guider frame is positioned in the use position as illustrated in FIG. 11, and releasing the switch 394 to reengage the locking mechanism 310 so as to lock the guider frame 390 into the use position.

Referring to FIGS. 11, 15, and 16, the elliptical exercise apparatus 300 of the third embodiment includes a gas spring 399 interconnected between the front member 396 of the guider frame 390 and the frame support 322 of the frame 320. When the elliptical exercise apparatus 300 is in the use position, the gas spring 399 is compressed. Conversely, when the elliptical exercise apparatus 300 is in the storage position, the gas spring 399 is elongated. During the folding process, the gas spring 399 may assist the user to lift up the guider frame 390. During the unfolding process, the gas spring 399 may slow the descending speed and reduce the downward impact force.

Referring to FIG. 13, there are two stopping pins 361*a* respectively mounted concentrically into the centers of the rollers 361. The stopping pins 361*a* protrude inwardly toward the longitudinal centerline V1 of the exercise apparatus 300, and the free ends of the stopping pins ride along inside the corresponding slots 392 of the guider frame 390. Referring to FIG. 15, when the user folds up the guider frame 390 from the use position, the rear ends 360*b* of the left and right supporting rods 360 are also lifted up by the guider frame 390. During the folding process, the rear ends 360*b* of the left and right supporting rods 360 move backward relative to the corresponding left and right tracks 391. At least one of the rear ends 360*b* of the supporting rods 360 then moves over the rear point P2, thereby causing the corresponding roller 361 to engage with the supplemental section 391*a* of the track 391. As the guider frame 390 is further lifted up toward the storage position, the stopping pin 361*a* corresponding to the rear-most roller 361 reaches the end of the corresponding slot 392, thereby preventing the rear-most roller 361 and the corresponding supporting rod 360 from any further rearward travel with respect to the guider frame 390. As the guider frame 390 continues to be lifted up into the storage position, only the rear end 360*b* of the fore-most supporting rod 360 is able to move in the rearward direction with respect to the guider frame 390, until the guider frame 390 reaches the storage position.

As shown in FIG. 16, the guider frame 390 is shown in the storage position, the rear end 360*b* of the right supporting rod 360 is shown stopped by a closed rear end of the right slot 392 and the right roller 361 is engaged with the right supplemental section 391*a* of the right track 391. To better understand how the exercise apparatus 300 behaves as it is folded from the use position of FIG. 11 into the storage position of FIG. 16, each step is reviewed. As the guider frame 390 is lifted up, the rear end 360*b* of the right supporting rod 360 starts moving backward until the stopping pin 361*a* is stopped by the closed rear end of the right slot 392. Once the stopping pin 361*a* is stopped by the closed rear end of the right slot 392, the rear end 360*b* of the right supporting rod 360 can not be moved backward anymore and stays at a terminal point Pt corresponding to an actual rear end of the supplemental section 391*a* of the right track 391. Thus, a length T2 from the rear point P2 to the terminal point Pt can be regarded as the length of the supplemental sections 391*a* of the left and right tracks 391. The rear end 360*b* of the left supporting rod 360 also enters the supplemental section 391*a* of the left track 391 and keeps moving backward during the folding process. However, the rear end 360*b* of the left supporting rod 360 of the third embodiment does not align with the terminal point Pt when the guider frame 390 is finally folded into the storage position as shown in FIG. 16. When the folding process is finished, the left and right handles 383 are naturally aligned, as seen from a side view in FIG. 16. This alignment of the left and right handles 383 in the folded position is due to the geometry of the exercise apparatus 300, including, but not limited to the lengths of the swing arms 380, the locations of the corresponding pivot points 381 relative to the frame 320, the lengths L1 of the supporting rods 360, the linkage between the cranks arms 332 and the supporting rods 360, and the length of the left and right track 391. No matter which positions the left and right rollers 361 are located in before folding, the final geometry of the folded exercise apparatus 300 will be substantially as shown in FIG. 16. However, while the left and right handles 383 should be substantially aligned when the exercise apparatus 300 is in the storage position, it may be the rear end 360*b* of the left supporting rod 360 that is located at the terminal point Pt rather than the right supporting rod 360. In other words, in the third embodiment, the user can fold up the elliptical exercise apparatus 300 as illustrated in FIG. 16. The user can also fold up the elliptical exercise apparatus 300 with the left and right supporting member in reverse position with respect to FIG. 16, (i.e. the rear end 360*b* of the left supporting rod 360 is in a position corresponding to the terminal point Pt).

In the third embodiment of the invention, as shown in FIG. 16, the closed rear end of the right slot 392 obstructs the right roller 361 first and then indirectly compels the left roller 361 to move backward during the folding process. In the storage position, the right crank arm 332 is slightly declined with respect to the ground surface, and the right supporting rod 360 is substantially vertical relative to the ground surface. The right roller 361 is stopped at the terminal point Pt. In comparison, the left crank arm 332 is slightly inclined with respect to the ground surface, and the left supporting rod 360 is inclined upward and backward. The left roller 361 is also positioned at the supplemental section 391*a* of the left track 391, but is not at the terminal point Pt thereof. The left roller 361 is lower than the right roller 361. In addition, the left and right links 350 are positioned by the left and right supporting rods 360 to be substantially vertical. Moreover, the elliptical exercise apparatus 300 has a footprint area on the surface. When the elliptical exercise apparatus is folded into its storage position, the corresponding footprint area has a first length L4 as measured from the front end of the frame 320 to the bottom surface of the guider frame 390. Preferably, the first length L4 is between the diameter D1 of the circular path R and twice the diameter D1 thereof. In the third embodiment as shown in FIG. 16, the first length L4 is substantially equal to 1.8 times of the diameter D1 of the circular path R. Comparing FIGS. 11 and 16, when the elliptical exercise apparatus 300 is in the use position, the length of the footprint area of the elliptical exercise apparatus is almost 3.8 times longer than the first length L4. The footprint area of the elliptical exercise apparatus 300 in the storage position is therefore significantly reduced. The third embodiment of the invention is both compact either in the use or storage position. The addition of the supplemental section 391*a* to the overall length of guider frame 390 does not increase the first length L4 in the third embodiment shown in FIG. 16 when the exercise apparatus 300 is folded in the storage position, and only adds length T2 to the overall length of the exercise apparatus 300 when the exercise apparatus 300 is extended into the use position.

When the elliptical exercise apparatus 300 of the third embodiment is in the storage position, the guider frame 390 is locked by the locking mechanism 310, and when the locking mechanism 310 is unlocked, the guider frame 390 is urged to rotate upward by the gas spring 399. The guider frame 390 can also be locked in the storage position by the locking mechanism 310. In the storage position, the rear ends 360*b* of the left and right supporting rods 360 are prevented from moving either upward or forward to disengage from the left and right tracks 391 by the stopping pins 361*a* riding in the respective slots 392. In other possible embodiments, the slots 392 may be optional, for instance, if the guider frame 390 is not required to rotate up into a nearly vertical orientation when folded into the storage position.

In the third embodiment, as shown in FIG. 16, the guider frame 390 is locked in the storage position. However, even though the guider frame 390 is locked into a fixed storage position, the crank arms 332 and the left and right swing arms 380 are not necessarily completely stationary. For example, if the right roller 361 is located at the terminal point Pt, as shown in FIG. 16, and the user pulls back the handle 383 of the right swing arm 380 and pushes forward the handle 383 of the left swing arm 380, the right supporting rod 360 is accordingly lowered and the left supporting rod 360 is accordingly raised. The crank arms 332 are also correspondingly rotated counterclockwise observed from the right side. In other words, it is possible to force the left roller 361 to move up until it is located at the terminal point Pt, thereby reversing the positions of the left and right rollers 361. However, this motion is minimal, and as the left and right handles 383 are substantially aligned when the exercise apparatus 300 is in the storage position, even reversing the positions of the left and right rollers 361 does not dramatically change the footprint or overall configuration of the exercise apparatus 300.

Referring to FIG. 16, in order to increase stability of the exercise apparatus 300 in the storage position, there is a front lever 333 and a rear lever 334 coupled end to end configured to function as a rocker link. The front lever 333 is pivotally connected to the frame support 322 of the frame 320 with a pivot 333*a* location in front of the central portion of the rocker link, i.e. in front of location where the front lever 333 is coupled to the rear lever 334. In the third embodiment, the pivot 333*a* is substantially located in the center portion of the front lever 333. The front end of the front lever 333 is coupled with a stopper 333*b*, and the rear end of the rear lever 334 is pivotally coupled to the front end of the arm 398 of the guider frame 390 on a location which is in front of the first axis 395. Since the front lever 333 is pivoted about its central point, the two ends thereof move in substantially opposite direction. When the guider frame 390 is lifted upward, the arm 398 of the guider frame 390 pulls the rear lever 334 rearward. It makes the front lever 333 rotate counterclockwise when observed from the right side view. The front end of the front lever 333 which is coupled with the stopper 333*b* is free when the elliptical exercise apparatus 300 is in the use position. The stopper 333*b* is contact with a pulley 335 of the rotating assembly 330 when the elliptical exercise apparatus 300 is in the storage position, thereby preventing the pulley 335 from rotating. With the addition of the rocker link mechanism, substantially every mechanical part, excluding the switch 394, of the elliptical exercise apparatus 300 is fixed when the exercise apparatus 300 is folded into the storage position.

Figure 17:
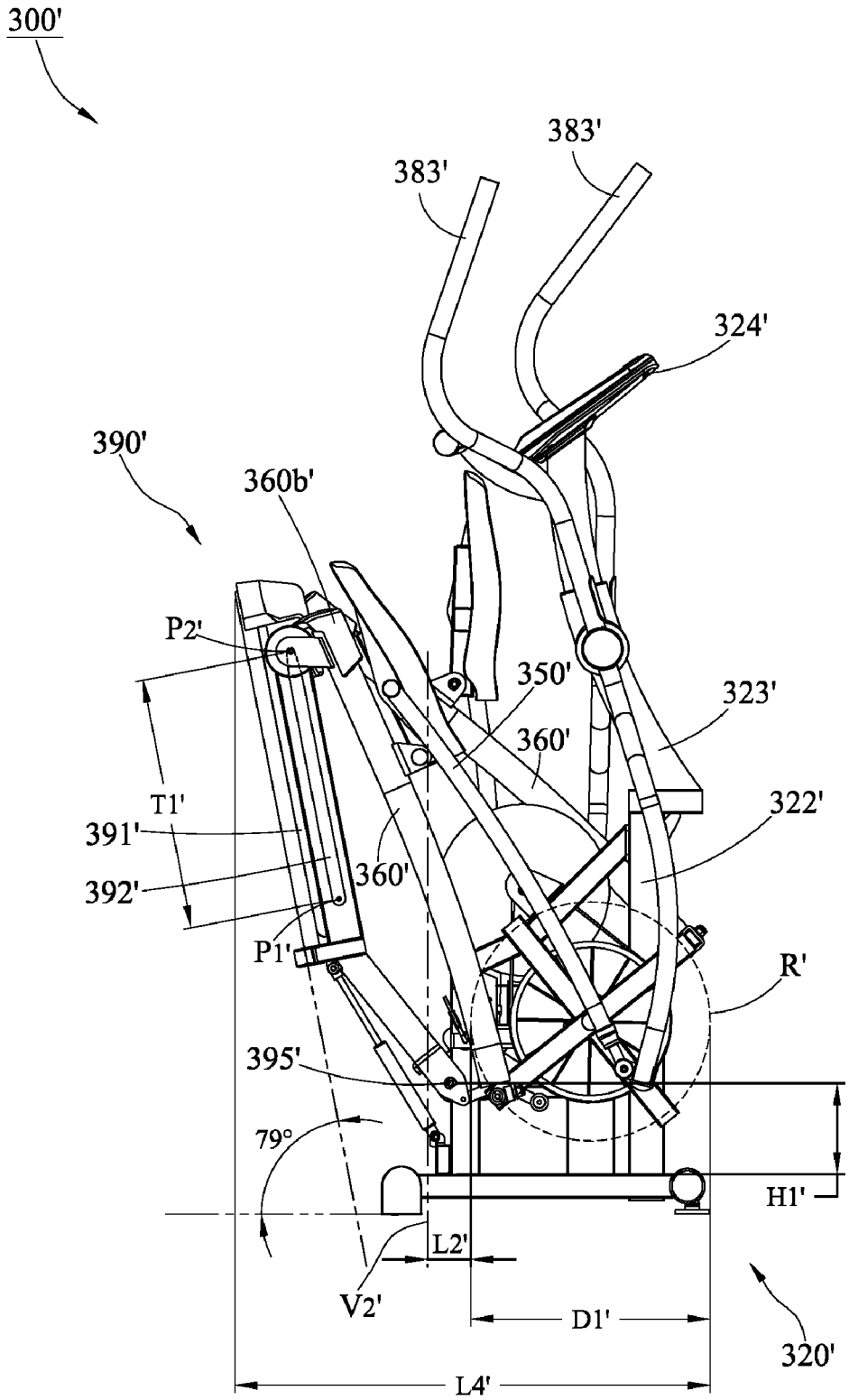
FIG. 17 is right side view of a fourth embodiment.

Referring to FIG. 17, a fourth embodiment of the present invention is illustrated therein. The only difference between the third embodiment and the fourth embodiment is that an elliptical exercise apparatus 300' as shown in the fourth embodiment does not have any supplemental sections rearward corresponding rear points P2' of left and right tracks 391'. In other words, the left and right tracks 391' are only as long as required to allow the rear ends 360*b*' of the left and right supporting rods 360' to perform reciprocating movement along a reciprocating path during the exercise, where the reciprocating path is a length of T1' which is the same length as the length T1 of the reciprocating path in the third embodiment. A guider frame 390' of the fourth embodiment is rotatably coupled to a frame 320' about a first axis 395' which is at the same location as in the third embodiment. Because there is no supplemental section, when the elliptical exercise apparatus 300' is folded up to the storage position, rear ends 360*b*' of left and right supporting rods 360' will move rearward until each rear end 360*b*' is obstructed by the corresponding rear ends of slots 392'. In other words, the rear ends 360*b*' of the left and right supporting rods 360' of the fourth embodiment are aligned from the side view as in the storage position. However, in the fourth embodiment as shown in FIG. 17, the guider frame 390' still can be rotated up to 79 degrees relative to the horizontal surface before each of the rear ends 360*b*' of the left and right supporting rods 360' is obstructed by the corresponding rear ends of slots 392'.

Similar to the third embodiment, the first axis 395' of the fourth embodiment is located in front of a vertical plane V2' and is positioned at a height H1'. The height H1' is also higher than the bottom edge of a circular path R'. A first length L4' of the footprint area when the elliptical exercise apparatus 300' is in the storage position is slight shorter than two times length of the diameter D1' of the circular path R'. Therefore, the fourth embodiment of the invention still has the compact features as the previous embodiments.

While the fourth embodiment, as shown in FIG. 17, only rotates up into a storage position that is at 79 degrees relative to the surface, if the first axis 395' is slightly adjusted to a higher location, the guider frame can be rotated up into a storage position that is at an angle greater than 79 degrees. The first axis 395' of the fourth embodiment may also be relocated farther forward, away from the vertical plane V2' to allow the guider frame can be rotated up into a storage position that is at an angle greater than 79 degrees. By adjusting the height of the first axis 395', and its distance from the vertical plane V2', the angle of the guider frame when it is rotated up into the storage position may be adjusted.

The present invention does not require that all the advantageous features and all the advantages need to be incorporated into every embodiment thereof. Although the present invention has been described in considerable detail with reference to certain preferred embodiment thereof, other embodiments are possible. For example, in an alternate embodiment, a preselected portion between the front and rear ends of each link is connected pivotally to the supporting member of the supporting rod directly, and each pedal is fixed secured to the rear end of the link without connecting to the supporting rod. In another alternate embodiment, the front end of a pedal and the rear end of a corresponding link mounted pivotally coaxially on the supporting member of the supporting rod, and the pedal and the link are connected at the pivot point, i.e. at least one of the pedal and the link is connected pivotally to the supporting rod, so that the pedal and the link can rotate about the supporting rod.

What is claimed is:

1. A stationary exercise apparatus, comprising:

a frame having a base adapted to rest on a surface, the frame defining a longitudinal centerline;

a guider frame connected to the frame about a first axis to be movable between a use position and a storage position, the guider frame having a track extending longitudinally when the guider frame is in the use position, the stationary exercise apparatus having a footprint area on the surface when the guider frame is in the storage position, and the footprint area having a longitudinal first length;

a rotating assembly rotatably connected to the frame for rotating along a circular path wherein the height between the track and the bottom edge of the circular path is not greater than 10 cm, a vertical plane being defined which is perpendicular to the longitudinal centerline and located approximately 10 cm rearward from a rear edge of the circular path, wherein the first axis is located on or in front of the vertical plane;

first and second supporting rods, each of the supporting rods having a front end pivotally connected to the rotating assembly and a rear end moving along the track of the guider frame between a front point and a rear point when the guider frame is in the use position, wherein the length of each of the supporting rods is substantially between the diameter of the circular path and twice the diameter thereof, and the first length of the footprint area when the guider frame is in the storage position is substantially between the diameter of the circular path and twice the diameter thereof; and first and second pedals respectively coupled to the first and second supporting rods to move along an arcuate closed path.

2. The stationary exercise apparatus of claim 1, wherein when the pedal is located in the foremost position of the arcuate closed path, a nearest distance between a front distal end of the pedal and the circular path is not longer than 20 cm.

3. The stationary exercise apparatus of claim 1, wherein the first and second pedals are located over the corresponding rear ends of the first and second supporting rods.

4. The stationary exercise apparatus of claim 1, wherein the first axis is located at a height relative to the base of the frame, and the height is higher than the bottom edge of the circular path.

5. The stationary exercise apparatus of claim 1, further comprising first and second swing arms respectively coupled to the frame on the left and right sides of the stationary exercise apparatus and first and second links coupled between the corresponding swing arms and the pedals.

6. The stationary exercise apparatus of claim 5, the track of the guider frame further comprising a supplemental section rearward of the rear point for supporting the rear ends of the first and second supporting rods when the guider frame is in the storage position, the first and second swing arms being substantially aligned when the guider frame is in the storage position.

7. A stationary exercise apparatus, comprising:

a frame having a base adapted to rest on a surface;

a guider frame connected to the frame about a first axis to be movable between a use position and a storage position, the stationary exercise apparatus having a footprint area on the surface and the footprint area having a longitudinal first length when the guider frame is in the storage position, the guider frame having a track extending longitudinally;

a rotating assembly rotatably connected to the frame for rotating along a circular path;

a supporting rod having a front end pivotally connected to the rotating assembly and a rear end moving along the track of the guider frame between a front point and a rear point, wherein the length of the supporting rod is substantially between the diameter of the circular path and twice the diameter thereof, and wherein the first length of the footprint area is substantially between the diameter of the circular path and twice the diameter thereof; and a pedal coupled to the supporting rod to move along an arcuate closed path.

8. The stationary exercise apparatus of claim 7, wherein when the pedal is located at the foremost position of the arcuate closed path, a nearest distance between a front distal end of the pedal and the circular path is not longer than 20 cm.

9. The stationary exercise apparatus of claim 8, wherein a height between the track of the guider frame and the bottom edge of the circular path is not longer than 10 cm.

10. The stationary exercise apparatus of claim 7, wherein the pedal is located over the rear end of the supporting rod.

11. The stationary exercise apparatus of claim 7, wherein a height between the track of the guider frame and the bottom edge of the circular path is not longer than 10 cm.

12. The stationary exercise apparatus of claim 7, further comprising a longitudinal centerline defined by the frame and a vertical plane perpendicular to the longitudinal centerline of the stationary exercise apparatus and located approximately 10 cm rearward from a rear edge of the circular path, the vertical plane dividing the stationary exercise apparatus into a front portion and a rear portion, wherein the first axis is located within the front portion of the stationary exercise apparatus.

13. The stationary exercise apparatus of claim 7, further comprising a swing arm pivotally coupled to the frame and a link interconnected to the swing arm and the pedal.

14. A stationary exercise apparatus, comprising:

a frame having a base adapted to rest on a surface;

a guider frame connected to the frame about a first axis to be movable between a use position and a storage position, the guider frame having a track extending longitudinally, wherein the first axis has a first height relative to the base of the frame;

a rotating assembly rotatably connected to the frame for rotating along a circular path;

a supporting rod having a front end pivotally connected to the rotating assembly and a rear end reciprocally moving along the track of the guider frame between a front point and a rear point, the length of the supporting rod being substantially between the diameter of the circular path and twice the diameter thereof, wherein the guider frame is configured to continuously engage the rear end of the supporting rod along a section of the track in front of the rear point as the guider frame is rotated about the first axis for all angular positions between 0 and at least 60 degrees as measured between the surface and the guider frame; and a pedal coupled to the supporting rod to moving along an arcuate closed path.

15. The stationary exercise apparatus of claim 14, wherein when the pedal is located in the foremost position of the arcuate closed path, a nearest distance between a front distal end of the pedal and the circular path is not longer than 20 cm.

16. The stationary exercise apparatus of claim 14, wherein a height between the bottom edge of the circular path and the track of the guider frame is not longer than 10 cm.

17. The stationary exercise apparatus of claim 14, further comprising a swing arm pivotally coupled to the frame and a link interconnected to the swing arm and the pedal.

18. The stationary exercise apparatus of claim 14, wherein the stationary exercise apparatus having a footprint area on the surface when the guider frame is at the storage position, and the footprint area having a longitudinal first length, and the first length of the footprint area when the guider frame is at the storage position is substantially between the diameter of the circular path and twice the diameter thereof.

19. The stationary exercise apparatus of claim 14, wherein the position of the first axis is forward of a location which is 10 cm rearward from the rear edge of the circular path.

* * * * *